US007441553B2

(12) United States Patent
Satoh

(10) Patent No.: US 7,441,553 B2
(45) Date of Patent: Oct. 28, 2008

(54) IGNITION COIL, MOUNTING STRUCTURE, AND METHOD FOR MOUNTING OF THE SAME

(75) Inventor: Yoshitaka Satoh, Toyohashi (JP)

(73) Assignee: Denso Corporation (JP)

( * ) Notice: Subject to any disclaimer, the term of this patent is extended or adjusted under 35 U.S.C. 154(b) by 0 days.

(21) Appl. No.: 11/798,831

(22) Filed: May 17, 2007

(65) Prior Publication Data

US 2007/0277795 A1 Dec. 6, 2007

(30) Foreign Application Priority Data

Jun. 1, 2006 (JP) ..... 2006-153340
Jun. 1, 2006 (JP) ..... 2006-153341

(51) Int. Cl.
*F02P 3/02* (2006.01)
*F02P 3/04* (2006.01)

(52) U.S. Cl. ..... 123/647

(58) Field of Classification Search ..... 123/634, 123/635, 647, 169 PH, 143 C; 313/625, 313/624; 439/125, 127
See application file for complete search history.

(56) References Cited

U.S. PATENT DOCUMENTS 3,716,038 A * 2/1973 Bevacqua ..... 123/634
5,411,006 A * 5/1995 Noble et al. ..... 123/634
5,664,954 A * 9/1997 Rea et al. ..... 439/125
5,685,282 A * 11/1997 Murata et al. ..... 123/635
6,508,216 B2 * 1/2003 Holmes et al. ..... 123/169 PA

FOREIGN PATENT DOCUMENTS

JP 2005-190937 7/2005

* cited by examiner

*Primary Examiner*—Mahmoud Gimie
(74) *Attorney, Agent, or Firm*—Nixon & Vanderhye PC

(57) ABSTRACT

An ignition coil, which is adapted to being mounted to a sparkplug, includes a coil body having a primary coil and a secondary coil. The ignition coil further includes a plug cap provided to an axial end of the coil body. The coil body is adapted to being mounted to the sparkplug via the plug cap. The plug cap has a plug-fitting hole adapted to being axially fitted to an insulator of the sparkplug. The plug cap has an end surface defining the plug-fitting hole. The end surface includes circumferential portions respectively located at axial positions each being different from each other with respect to a circumferential direction.

16 Claims, 19 Drawing Sheets

IGNITION COIL, MOUNTING STRUCTURE, AND METHOD FOR MOUNTING OF THE SAME

CROSS REFERENCE TO RELATED APPLICATIONS

This application is based on and incorporates herein by reference Japanese Patent Applications No. 2006-153340 filed on Jun. 1, 2006 and No. 2006-153341 filed on Jun. 1, 2006.

FIELD OF THE INVENTION

The present invention relates to an ignition coil for an internal combustion engine. The present invention further relates to a mounting structure for an ignition coil device, which includes the ignition coils, to the internal combustion engine. The present invention further relates to a method for mounting the ignition coil to the internal combustion engine.

BACKGROUND OF THE INVENTION

An internal combustion engine has plugholes inserted with ignition coils. Each of the ignition coils includes a coil body constructed of a primary coil and a secondary coil. The coil body is provided with a plug cap formed of rubber. Each of the spark plugs includes an insulator fitted into a plug-fitting hole of the plug cap. The insulator has a tip end including a conductive terminal to be in contact with a secondary terminal (high voltage terminal), which is conductive with a high voltage winding end of the secondary coil, or a coil spring. The plug cap is provided for electrically insulating around the conductive terminal of the spark plug and protecting the conductive terminal from intrusion of water.

In this structure, the inner diameter of the plug-fitting hole of each plug cap is less than the outer diameter of the insulator of each spark plug for defining a predetermined fitting margin to produce the electrically insulation property and waterproof property. Accordingly, large force is applied for fitting the insulator into the plug-fitting hole by radially widening the plug cap.

According to JP-A-2005-190937, the spark plug has a structure facilitating the fitting of the sparkplug into the plug-fitting hole.

In JP-A-2005-190937, the sparkplug is partially surrounded with a joint of the plug cap. The joint has an inner periphery defining a corrugation including annular protrusions and recessions. The insulator of the sparkplug does not have a corrugation. In this structure, friction can be reduced in the fitting of the insulator into the joint.

However, the structure of the JP-A-2005-190937 is effective only when the insulator of the sparkplug does not have a corrugation.

Specifically, when the insulator, which has the corrugation, is fitted into the plug cap having the corrugation described in JP-A-2005-190937, waterproof property may be insufficient in a portion where the annular recession of the corrugation of the insulator is opposed to the annular recession of the corrugation of the joint of the plug cap. In addition, when, for example, the annular protrusion of the corrugation of the insulator is fitted to the annular recession of the corrugation of the plug cap, large force is needed for fitting of the insulator into the plug-fitting hole.

Accordingly, the fitting force needs to be further reduced at least when the sparkplug including the insulator having the corrugation is applied. Furthermore, the fitting force needs to be reduced regardless of providing of the corrugation to the insulator of the sparkplug.

For example, a cassette-type ignition coil device includes multiple ignition coils provided to a base bracket. The base bracket is mounted to the engine together with the ignition coils, so that the ignition coils can be simultaneously mounted to the engine, correspondingly to the number of the cylinders. In this structure, the fitting force becomes greater proportionally to the number of the cylinders. Accordingly, the fitting force needs to be further reduced in the cassette-type ignition coil device.

SUMMARY OF THE INVENTION

The present invention addresses the above disadvantage. According to one aspect of the present invention, an ignition coil adapted to being mounted to a sparkplug, the ignition coil includes a coil body including a primary coil and a secondary coil. The ignition coil further includes a plug cap provided to an axial end of the coil body. The coil body is adapted to being mounted to the sparkplug via the plug cap. The plug cap has a plug-fitting hole adapted to being axially fitted to an insulator of the sparkplug. The plug cap has an end surface defining the plug-fitting hole. The end surface includes circumferential portions respectively located at axial positions each being different from each other with respect to a circumferential direction.

According to another aspect of the present invention, an ignition coil adapted to being mounted to a sparkplug, the ignition coil includes a coil body including a primary coil and a secondary coil. The ignition coil further includes a plug cap provided to an axial end of the coil body. The coil body is adapted to being mounted to the sparkplug via the plug cap. The plug cap has a plug-fitting hole adapted to being axially fitted to an insulator of the sparkplug. The plug cap has an inner circumferential edge defining the plug-fitting hole. The inner circumferential edge includes circumferential portions respectively located at axial positions each being different from each other with respect to a circumferential direction.

According to another aspect of the present invention, an ignition coil adapted to being mounted to a sparkplug, the ignition coil includes a coil body including a primary coil and a secondary coil. The ignition coil further includes a plug cap provided to an axial end of the coil body. The coil body is adapted to being mounted to the sparkplug via the plug cap. The plug cap has a plug-fitting hole adapted to being axially fitted to an insulator of the sparkplug. The plug cap has an end defining the plug-fitting hole. The end includes circumferential portions each having a radial thickness being changed with respect to a circumferential direction.

According to another aspect of the present invention, a mounting structure for an ignition coil device includes a plurality of ignition coils. The mounting structure for the ignition coil device further includes a base bracket. The plurality of ignition coils, which is arranged on the base bracket, is adapted to being connected respectively to a plurality of sparkplugs, which is screwed respectively to a plurality of plugholes of the internal combustion engine, by mounting the base bracket to the internal combustion engine. Each of the plurality of ignition coils includes a coil body including a primary coil and a secondary coil. Each of the plurality of ignition coils further includes a plug cap provided to an axial end of the coil body, the plug cap being water-resistive and electrically insulative. Each of the plurality of plug caps has a plug-fitting hole adapted to being fitted to an insulator of each of the spark plugs. At least one of the plurality of plug caps has an end located at a first axial position. At least one of an other of the plurality of plug caps has an end located at a second axial position. The first axial position is different from the second axial position.

According to another aspect of the present invention, a mounting structure for an ignition coil device includes a plurality of ignition coils. The mounting structure for the ignition coil device further includes a base bracket. The plurality of ignition coils, which is arranged on the base bracket, is adapted to being connected respectively to a plurality of sparkplugs, which is screwed respectively to a plurality of plugholes of the internal combustion engine, by mounting the base bracket to the internal combustion engine. Each of the plurality of ignition coils includes a coil body including a primary coil and a secondary coil. Each of the plurality of ignition coils further includes a plug cap provided to an axial end of the coil body, the plug cap being water-resistive and electrically insulative. Each of the plurality of plug caps has a plug-fitting hole adapted to being fitted to an insulator of each of the spark plugs. Each of the plurality of plugs has an end surface, which defines the plug-fitting hole, being an inclined surface. At least one of the plurality of plug caps has an end surface, which defines the plug-fitting hole, being inclined by a first inclination angle. At least an other of the plurality of plug caps has an end surface, which defines the plug-fitting hole, being inclined by a second inclination angle. The first inclination angle is different from the second inclination angle.

According to another aspect of the present invention, a mounting structure for an ignition coil device includes a plurality of ignition coils. The mounting structure for the ignition coil device further includes a base bracket. The plurality of ignition coils, which is arranged on the base bracket, is adapted to being connected respectively to a plurality of sparkplugs, which is screwed respectively to a plurality of plugholes of the internal combustion engine, by mounting the base bracket to the internal combustion engine. Each of the plurality of ignition coils includes a coil body including a primary coil and a secondary coil. Each of the plurality of ignition coils includes a plug cap provided to an axial end of the coil body, the plug cap being water-resistive and electrically insulative. Each of the plurality of plug caps has a plug-fitting hole adapted to being fitted to an insulator of each of the spark plugs. At least one of the plurality of plug caps has a first end having a first shape. The first end is formed of a first material. The first end has a first roughness. At least one of an other of the plurality of plug caps has a second end having a second shape. The second end is formed of a second material. The second end has a second roughness. One of the first shape, the first material, and the first roughness is different from corresponding one of the second shape, the second material, and the second roughness.

According to another aspect of the present invention, a mounting structure for an ignition coil device includes a plurality of ignition coils. The mounting structure for the ignition coil device further includes a base bracket. The plurality of ignition coils, which is arranged on the base bracket, is adapted to being connected respectively to a plurality of sparkplugs, which is screwed respectively to a plurality of plugholes of the internal combustion engine, by mounting the base bracket to the internal combustion engine. Each of the plurality of ignition coils includes a coil body including a primary coil and a secondary coil. Each of the plurality of ignition coils includes a plug cap provided to an axial end of the coil body, the plug cap being water-resistive and electrically insulative. Each of the plurality of plug caps has a plug-fitting hole adapted to being fitted to an insulator of each of the spark plugs. The base bracket is provided with a cover surrounding a connector head portion of each of the plurality of ignition coils. The cover and the connector head portion interpose an elastic member for generating elastic force between the cover and the connector head portion. The elastic member is eccentric with respect to a center axis of each of the plurality of ignition coils.

According to another aspect of the present invention, a mounting structure for an ignition coil device includes a plurality of ignition coils. The mounting structure for the ignition coil device further includes a base bracket. The plurality of ignition coils, which is arranged on the base bracket, is adapted to being connected respectively to a plurality of sparkplugs, which is screwed respectively to a plurality of plugholes of the internal combustion engine, by mounting the base bracket to the internal combustion engine. Each of the plurality of ignition coils includes a coil body including a primary coil and a secondary coil. Each of the plurality of ignition coils includes a plug cap provided to an axial end of the coil body, the plug cap being water-resistive and electrically insulative. Each of the plurality of plug caps has a plug-fitting hole adapted to being fitted to an insulator of each of the spark plugs. The base bracket is provided with a cover surrounding a plurality of connector head portions of the plurality of ignition coils. The cover and the plurality of connector head portions interpose a plurality of elastic members for producing elastic force respectively between the cover and the plurality of connector head portions. At least one of the plurality of elastic members produces first elastic force. At least one of an other of the plurality of elastic members produces second elastic force. The first elastic force is different from the second elastic force.

According to another aspect of the present invention, a mounting structure for an ignition coil device includes a plurality of ignition coils. The mounting structure for the ignition coil device further includes a base bracket. The plurality of ignition coils, which is arranged on the base bracket, is adapted to being connected respectively to a plurality of sparkplugs, which is screwed respectively to a plurality of plugholes of the internal combustion engine, by mounting the base bracket to the internal combustion engine. Each of the plurality of ignition coils includes a coil body including a primary coil and a secondary coil. Each of the plurality of ignition coils includes a plug cap provided to an axial end of the coil body, the plug cap being water-resistive and electrically insulative. Each of the plurality of plug caps has a plug-fitting hole adapted to being fitted to an insulator of each of the spark plugs. The base bracket is bent with respect to a direction, in which the plurality of ignition coils is arranged, in an initial condition before the base bracket is mounted to the engine. The plurality of ignition coils, which is arranged on the base bracket, is connected respectively to the plurality of sparkplugs, which is screwed respectively to the plurality of plugholes, by mounting the base bracket being bent to the internal combustion engine.

According to another aspect of the present invention, a method for mounting an ignition coil to an internal combustion engine, the method includes screwing a sparkplug to a plughole of the internal combustion engine. The method further includes fitting the ignition coil to the sparkplug by inserting an insulator of the sparkplug into a fitting hole defined in an end of a plug cap provided to an axial end of the ignition coil. The fitting of the end of the plug cap is circumferentially staggered to reduce a peak of fitting force applied to the plug cap.

According to another aspect of the present invention, a method for mounting a plurality of ignition coils to an internal combustion engine, the method includes screwing a plurality of sparkplugs respectively to a plurality of plugholes of the internal combustion engine. The method further includes connecting the plurality of ignition coils to a base bracket. The method further includes mounting the base bracket to the internal combustion engine, thereby fitting plug caps provided to axial ends of the plurality of ignition coils respectively to insulators of the plurality of sparkplugs. The fitting of at least one of the plug caps is delayed relative to at least one of an other of the plug caps to reduce a peak of fitting force applied to the plug caps.

According to another aspect of the present invention, a method for mounting a plurality of ignition coils to an internal combustion engine, the method includes screwing a plurality of sparkplugs respectively to a plurality of plugholes of the internal combustion engine. The method further includes connecting the plurality of ignition coils to the base bracket. The method further includes bending a base bracket. The method further includes mounting the base bracket to the internal combustion engine, thereby fitting plug caps provided to axial ends of the plurality of ignition coils respectively to insulators of the plurality of sparkplugs. The fitting of at least one of the plug caps is delayed relative to at least one of an other of the plug caps by bending of the base bracket to stagger axial positions of the plurality of ignition coils, thereby reducing a peak of fitting force applied to the plug caps.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF PREFERRED EMBODIMENTS

First Embodiment

Figure 1:
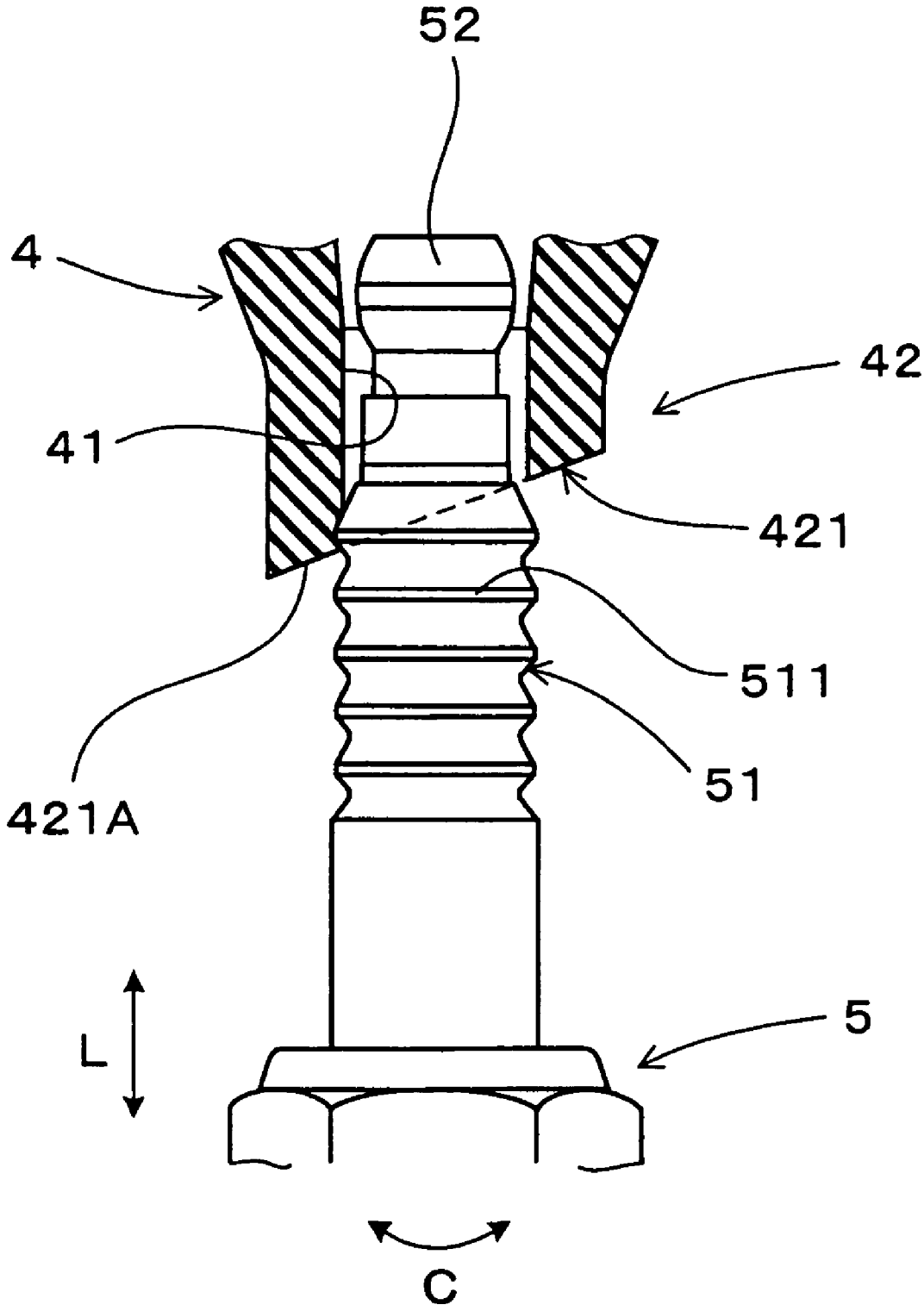
FIG. 1 is a partially sectional view showing an insulator of a sparkplug fitted into a plug-fitting hole of a plug cap, according to a first embodiment.

In this embodiment, as shown in FIG. 1, 2, a coil body 11 includes a primary coil 21 and a secondary coil 22. The coil body 11 has one axial end 111 provided with a plug cap 4 formed of rubber. The coil body 11 is connected with a sparkplug 5 via the plug cap 4.

Referring to FIG. 1, the plug cap 4 has a plug-fitting hole 41 extending with respect to the axial direction L. The plug-fitting hole 41 is inserted with an insulator 51 of the sparkplug 5. The plug cap 4 has one axial end having an opening end surface 421 defining the tip end of the plug-fitting hole 41. In this embodiment, the opening end surface 421 has circumferential portions with respect to the circumferential direction C. The axial positions of the circumferential portions of the opening end surface 421 are variously changed.

As follows, an ignition coil 1 of this embodiment is described with reference to FIGS. 1 to 7. As shown in FIG. 3, the ignition coil 1 is a stick-type coil having the coil body 11 constructed of the primary coil 21 and the secondary coil 22. The coil body 11 is inserted into a plughole 81 in a cylinder head cover of an engine 8.

Figure 2:
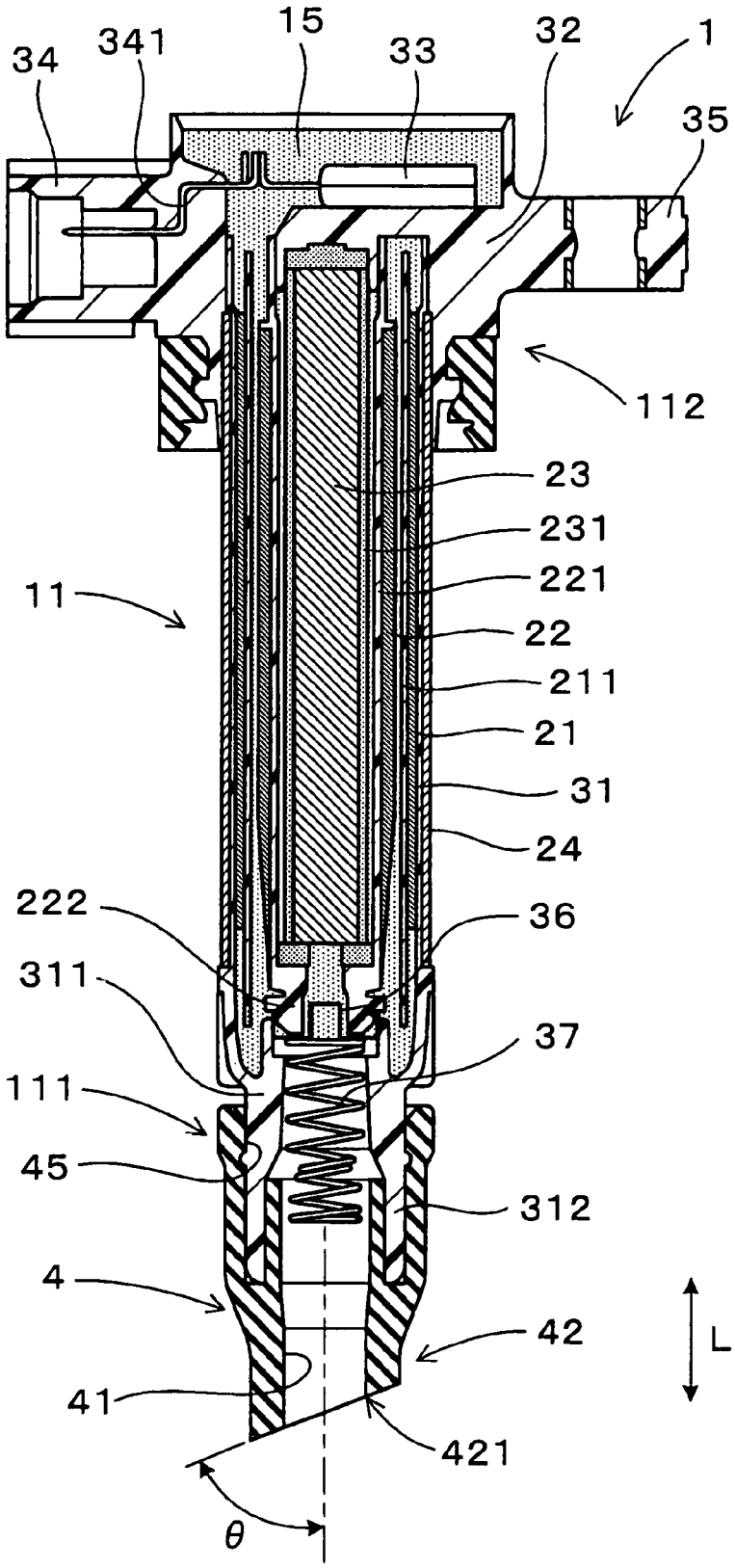
FIG. 2 is a partially sectional view showing an ignition coil provided with the plug cap, according to the first embodiment.
Figure 3:
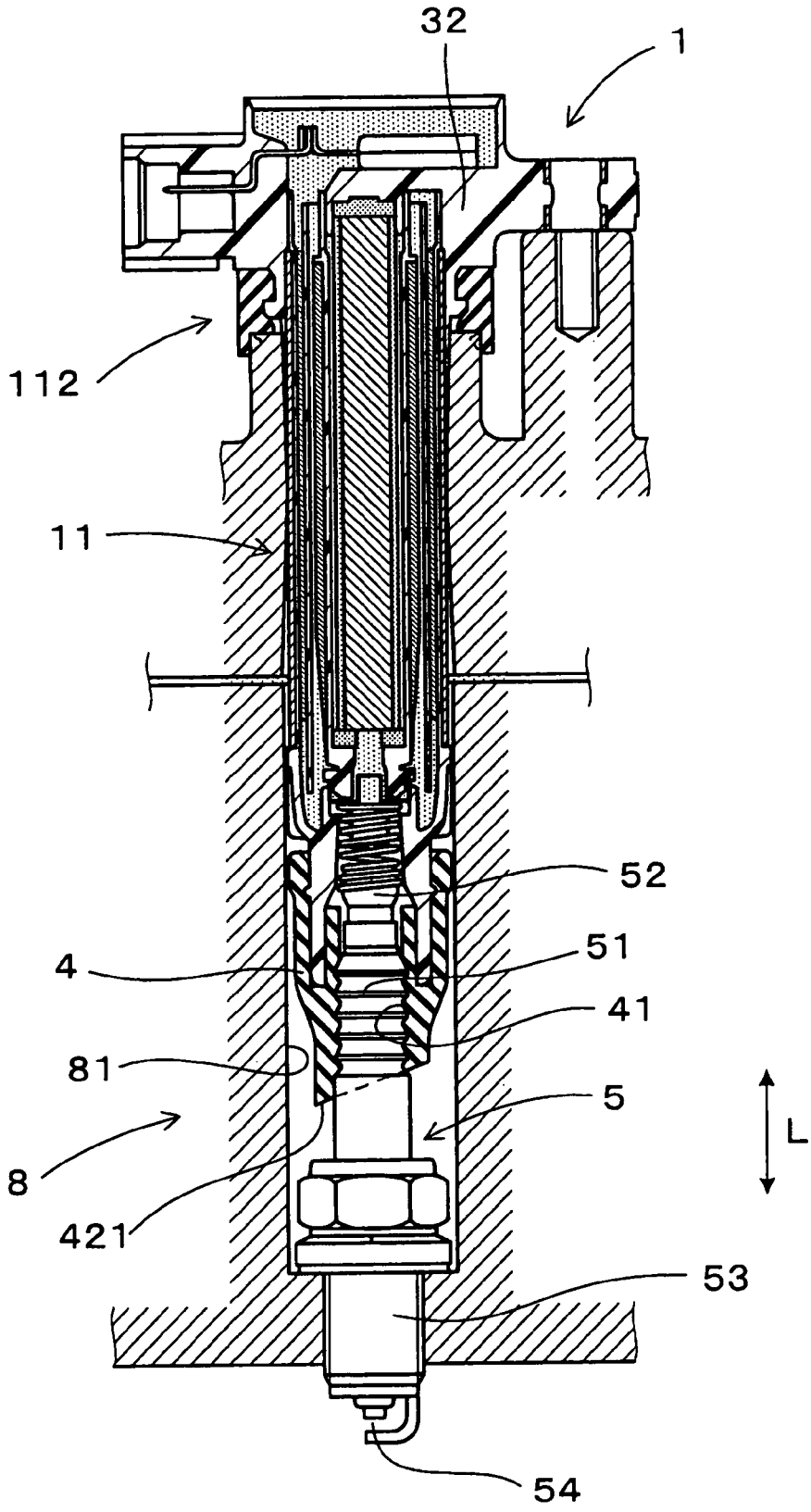
FIG. 3 is a partially sectional view showing the ignition coil fitted into a plughole of the engine, according to the first embodiment.

As shown in FIG. 2, the primary coil 21 includes a primary spool 211, which is a cylindrical resin member, and a primary wire, which is applied with an electrically insulative coating. The primary coil 21 is constructed by winding the primary wire around the outer circumferential periphery of the primary spool 211 by a primary winding number. The secondary coil 22 includes a secondary spool 221, which is a cylindrical resin member, and a secondary wire, which is applied with an electrically insulative coating. The secondary coil 22 is constructed by winding the secondary wire around the outer circumferential periphery of the secondary spool 221 by a secondary winding number, which is greater than the primary winding number. The secondary coil 22 is arranged on the radially inner side of the primary coil 21. A center core 23 is arranged on the radially inner side of the secondary coil 22. The center core 23 is formed of a magnetic material. The primary coil 21 is arranged in a coil case 31, which is a cylindrical resin member. An outer core 24 is provided on the radially outer side of the coil case 31. The primary spool 211 and the secondary spool 221 are formed of thermoplastic resin.

The center core 23 is constructed by stacking substantially flat electromagnetic steel plates such as silicon steel plates applied with an electrically insulative coating. Each of the electromagnetic steel plates defines the axial section of the center core 23 perpendicular to the axial direction L of the ignition coil 1. The outer core 24 is constructed of multiple substantially cylindrical electromagnetic steel plates such as silicon steel plates having at least one silt (gap) with respect to the axial direction L. The electromagnetic steel plates are stacked with respect to the radial direction R via adhesion bond to construct the outer core 24. The center core 23 and the outer core 24 define therebetween a magnetic path through which magnetic flux is formed by supplying electricity to the primary coil 21. A stress relaxation tape 231 is wound around the outer circumferential periphery of the center core 23.

Referring to FIG. 2, the coil body 11 has the other axial end 112 provided with an igniter case 32 having an igniter 33. The igniter 33 is provided for supplying electric power to the primary coil 21.

The igniter case 32 defines a cavity accommodating the igniter 33. The igniter case 32 has a case fitting hole into which the coil case 31 and the outer core 24 are fitted. The igniter case 32 includes a connector portion 34 and a flange portion 35. Electrically conductive pins 341 are insert-molded in the connector portion 34 such that the electrically conductive pins 341 radially outwardly extend. The igniter 33 includes electrically conductive pins, which are respectively conductive with the electrically conductive pins 341 of the connector portion 34. The ignition coil 1 is mounted to the engine 8, via the flange portion 35.

The igniter 33 includes an electric power control circuit including a switching element or the like operated by a signal transmitted from an engine control unit (ECU). The igniter 33 further includes an ion current detecting circuit for detecting ion current.

In this embodiment, the one axial end of the coil case 31 has a plug base portion 311 to be attached with the plug cap 4. The plug base portion 311 has an annular protrusion 312 fitted into an annular recession 45 of the plug cap 4.

The one axial end of the secondary spool 221 has an extended portion 222. The extended portion 222 and the plug base portion 311 therebetween interpose secondary terminals (high voltage terminals) 36 electrically conductive with a high voltage winding end of the secondary coil 22. A spring 37 is provided radially inner side of the plug base portion 311. The spring 37 is electrically conductive with the secondary terminal 36.

Referring to FIG. 3, the sparkplug 5 has an electrically conductive terminal portion 52. The sparkplug 5 is fitted into the plug-fitting hole 41 of the plug cap 4 in a condition where the electrically conductive terminal portion 52 is in contact with the spring 37.

Referring to FIG. 2, the coil case 31 and the igniter case 32 therebetween define a cavity into which a thermosetting resin 15 such as epoxy resin is charged. The thermosetting resin 15 is charged into a case 3. Specifically, the thermosetting resin 15 is charged into the cavity between the tape 231 around the outer circumferential periphery of the center core 23 and the secondary spool 221. The thermosetting resin 15 is further charged into gaps in a secondary winding constructing the secondary coil 22 and the cavity between the secondary coil 22 and the primary spool 211. The thermosetting resin 15 is further charged into gaps in a primary winding constructing the primary coil 21 and the cavity between the primary coil 21 and the outer core 24. The thermosetting resin 15 is further charged into the cavity between the outer core 24 and the case 3.

In the ignition coil 1, the ECU outputs a pulse-shaped spark-generating signal to the igniter 33, so that the electric power control circuit of the igniter 33 is activated. Electricity is supplied to the primary coil 21, so that the center core 23 and the outer core 24 form therebetween a magnetic field. The ECU terminates the electricity supplied to the primary coil 21, so that the center core 23 and the outer core 24 form therebetween an inductive magnetic field opposite to the magnetic field. The inductive magnetic field generates induced electromotive force (counter electromotive force) in the secondary coil 22, so that the sparkplug provided to the ignition coil 1 sparks.

Referring to FIG. 3, the sparkplug 5 includes the insulator 51, the electrically conductive terminal portion 52, a screw portion 53, and a pair of electrode portions 54. The insulator 51 includes multiple annular protrusions 511 arranged in parallel with each other with respect to the axial direction L, so that the insulator 51 forms a corrugation. The electrically conductive terminal portion 52 is provided in the other axial end of the insulator 51. The screw portion 53 extends from the insulator 51 toward the one axial end. The screw portion 53 is adapted to being screwed to the engine 8. The pair of electrode portions 54 is provided to the one axial end of the screw portion 53.

Figure 4:
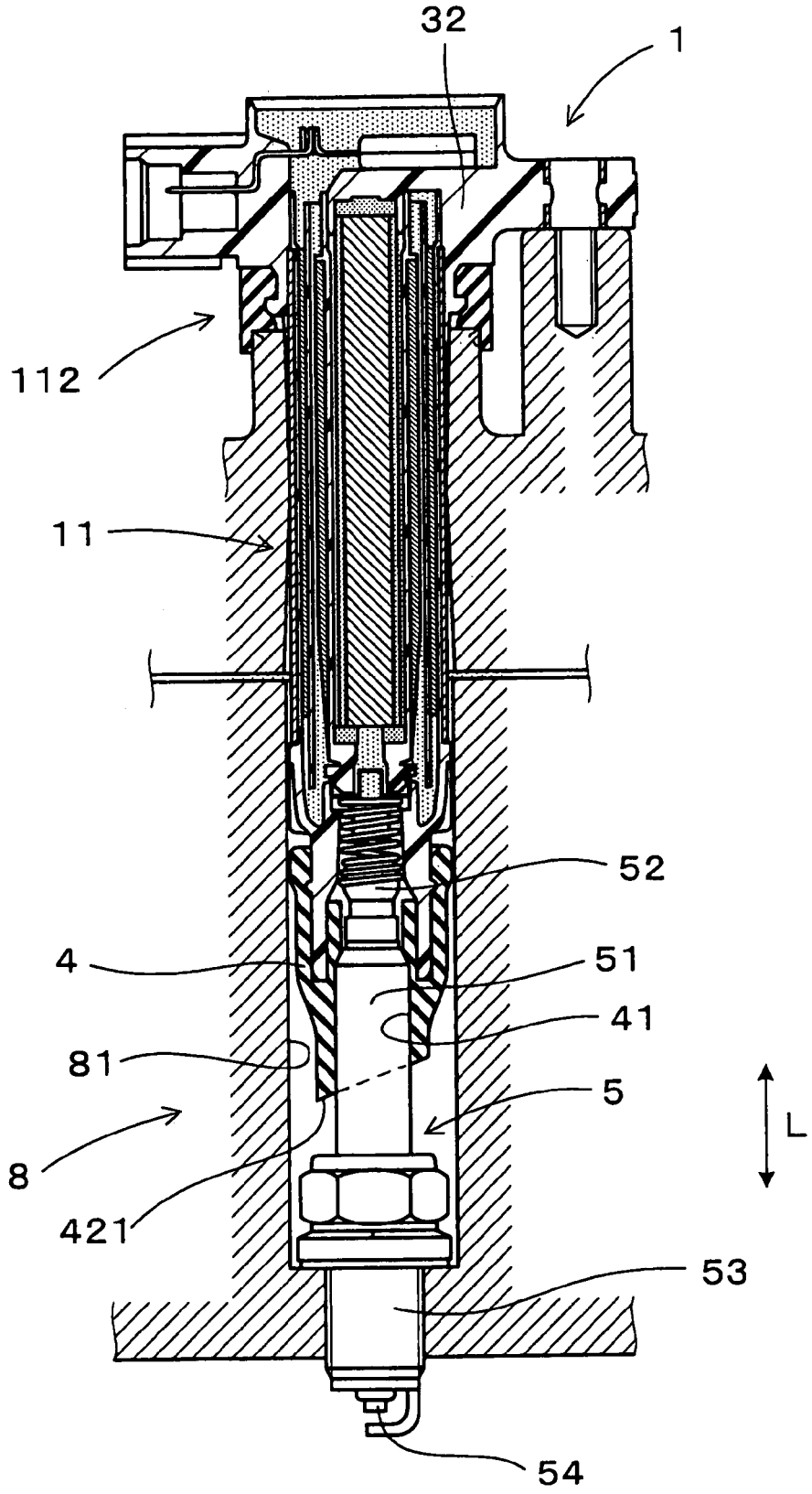
FIG. 4 is a partially sectional view showing the ignition coil fitted into the plughole screwed with another sparkplug, according to the first embodiment.

As shown in FIG. 4, the sparkplug 5 may be provided with an insulator 51 without the annular protrusions 511, i.e., without the corrugation.

Referring to FIGS. 1, 2, in this embodiment, the opening end surface 421 of the plug cap 4 is entirely inclined to one side to define an inclined surface. The opening end surface 421 has circumferential portions with respect to the circumferential direction C. The axial positions of the circumferential portions of the opening end surface 421 are continuously and gradually changed. The opening end surface 421 is inclined by an inclination angle θ, between 60° and 88°, with respect to the center axis of the plug cap 4.

In this embodiment, referring to FIG. 1, the circumferential portions of the opening end surface 421 of the plug cap 4 with respect to the circumferential direction C includes an axial end surface 421A. The axial end surface 421A is an outermost portion protruding from the opening end surface 421 with respect to the axial direction L (one end relative to the axial direction L). The insulator 51 of the sparkplug 5 is fitted into the plug-fitting hole 41 of the plug cap 4 of the ignition coil 1. In this condition, the insulator 51 primarily makes contact with the axial end surface 421A. In this structure, the fitting starts primarily from the axial end surface 421A most protruding from the opening end surface 421 with respect to the axial direction L. Starting of the fitting is delayed at each circumferential portion of the plug-fitting hole 41 with respect to the circumferential direction C. Therefore, fitting force necessary for starting of the fitting of the insulator 51 can be reduced.

In this embodiment, the shape of the opening end surface 421 of the plug cap 4 has a feature, not the shape of the inner circumferential periphery of the plug-fitting hole 41. Therefore, the ignition coil 1 in this embodiment can be applied to both the sparkplug 5 having the corrugation in the insulator 51 and the sparkplug 5 not having the corrugation in the insulator 51.

In this embodiment, various kinds of sparkplugs 5 can be applied to the ignition coil 1, so that versatility of the ignition coil 1 can be enhanced. In addition, the fitting force applied when the plug cap 4 is fitted to the sparkplug 5 can be reduced.

The opening end surface 421 of the plug cap 4 is not limited to being in the inclined surface entirely slanted to one direction. The opening end surface 421 may be in various shapes as described below.

Figure 5:
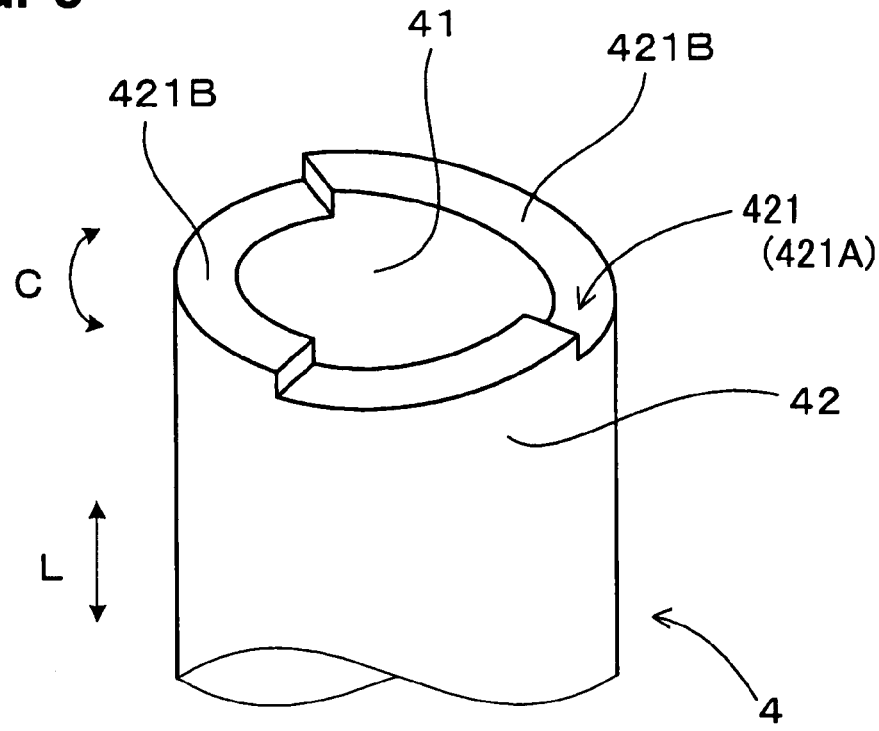
FIG. 5 is a perspective sectional view showing an opening end surface of another plug cap, according to the first embodiment and a seventh embodiment.

For example, as shown in FIG. 5, the opening end surface 421 of the plug cap 4 may have multiple inclined surfaces 421B, which are repeatedly formed with respect to the circumferential direction C.

Figure 6:
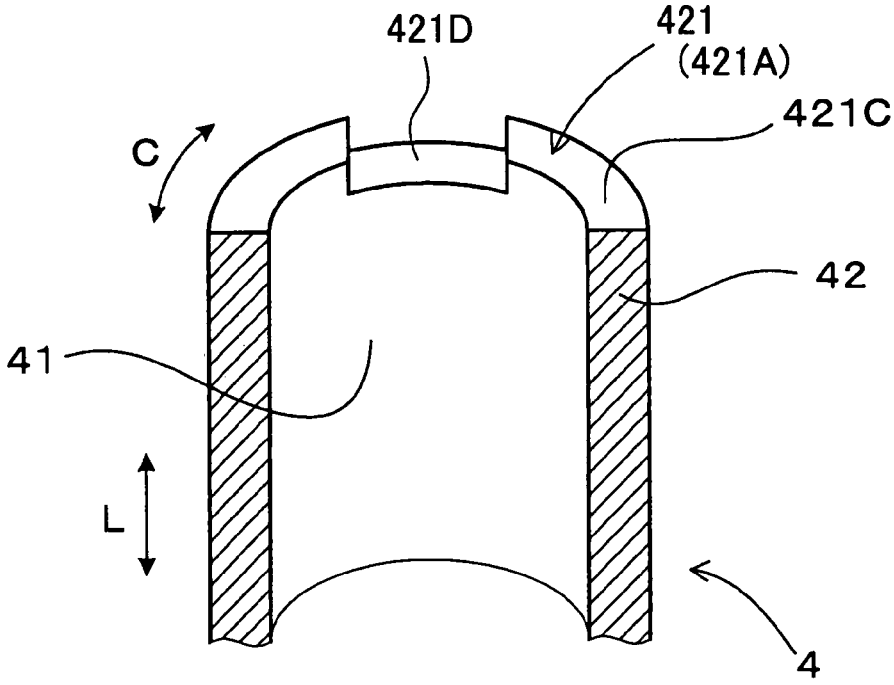
FIG. 6 is a perspective sectional view showing an opening end surface of another plug cap, according to the first embodiment and the seventh embodiment.
Figure 7:
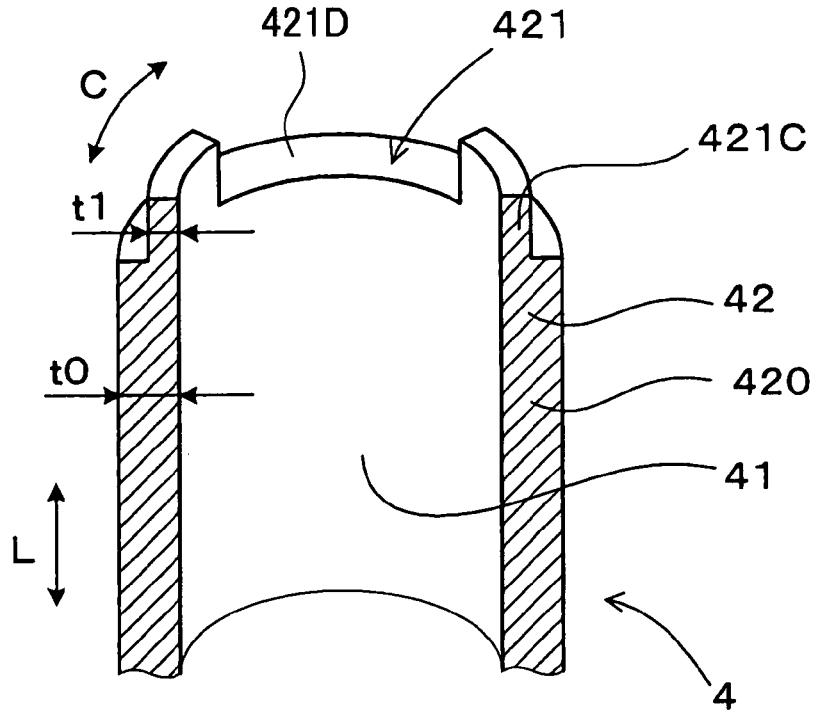
FIG. 7 is a perspective sectional view showing an opening end surface of another plug cap, according to the first embodiment and the seventh embodiment.

As shown in FIG. 6, the opening end surface 421 of the plug cap 4 may have a stepwise surface defining protrusions 421C partially with respect to the circumferential direction C. Each of the protrusions 421C protrudes with respect to the axial direction L. As shown in FIG. 7, each of the protrusions 421C may have a thickness t1, which is less than a thickness t0 of a main portion 420 of an axial tip end (opening tip end) 42.

Each of FIGS. 6, 7 depicts the cross section of the axial tip end 42 of the plug cap 4. Unillustrated remaining portion is symmetric to the depicted portion.

Second Embodiment

Figure 8:
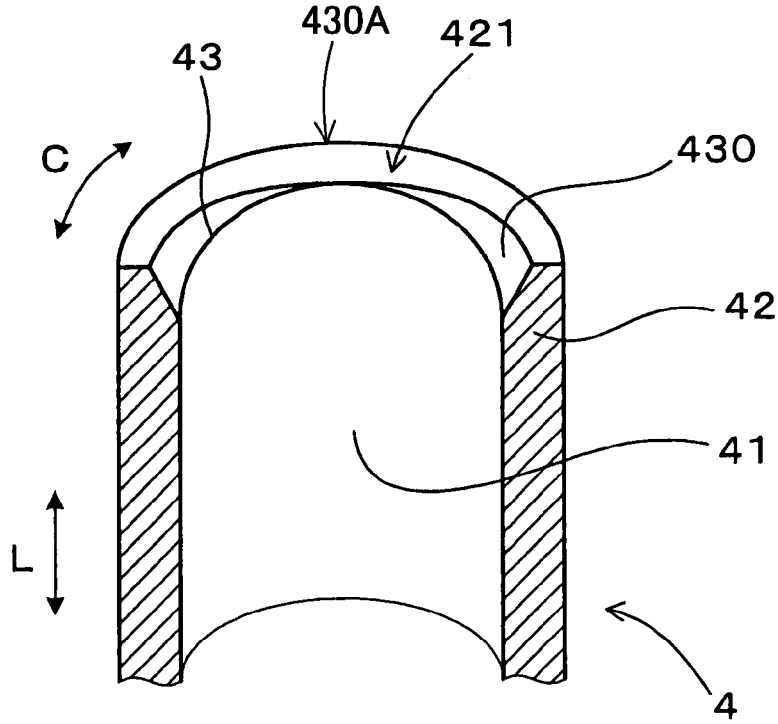
FIG. 8 is a perspective sectional view showing an inner circumferential edge of another plug cap, according to a second embodiment and the seventh embodiment.

As shown in FIG. 8, in this embodiment, the plug cap 4 has inner circumferential edges 43 defining therein the plug-fitting hole 41. The axial positions of each of the inner circumferential edges 43 are variously changed with respect to the circumferential direction C.

In this embodiment, each of the inner circumferential edges 43 of the plug-fitting hole 41 has an inclined surface defined by being partially cut. In this embodiment, each of the inner circumferential edge 43 has an inclined surface 430 defined by being cut to be in a substantially oval shape when being viewed from the axial direction L of the plug cap 4. Two of the inner circumferential edges 43 are formed to be opposed to each other.

In this embodiment, each of the inner circumferential edges 43 defining the plug-fitting hole 41 has circumferential portions with respect to the circumferential direction C. The circumferential portions include a most protruding portion 430A protruding toward the tip end with respect to the axial direction L. The insulator 51 of the sparkplug 5 is fitted into the plug-fitting hole 41 of the plug cap 4 of the ignition coil 1. In this condition, the insulator 51 primarily makes contact with the most protruding portion 430A of the circumferential portions of the inner circumferential edges 43 defining the plug-fitting hole 41. In this structure, the fitting starts primarily from the most protruding portion 430A most protruding with respect to the axial direction L. Starting of the fitting is delayed at each circumferential portion of the plug-fitting hole 41 with respect to the circumferential direction C. Therefore, fitting force necessary for starting of the fitting of the insulator 51 can be reduced.

In this embodiment, the shape of each inner circumferential edge 43 of the plug-fitting hole 41 has a feature, not the shape of the inner circumferential periphery of the plug-fitting hole 41. Therefore, the ignition coil 1 in this embodiment can be applied to both the sparkplug 5 having the corrugation in the insulator 51 and the sparkplug 5 not having the corrugation in the insulator 51.

In this embodiment, various kinds of sparkplugs 5 can be applied to the ignition coil 1, so that versatility of the ignition coil 1 can be enhanced. In addition, the fitting force applied when the plug cap 4 is fitted to the sparkplug 5 can be reduced.

In this embodiment, the inner circumferential edge 43 of the plug-fitting hole 41 may be in various shapes as described below.

Figure 9:
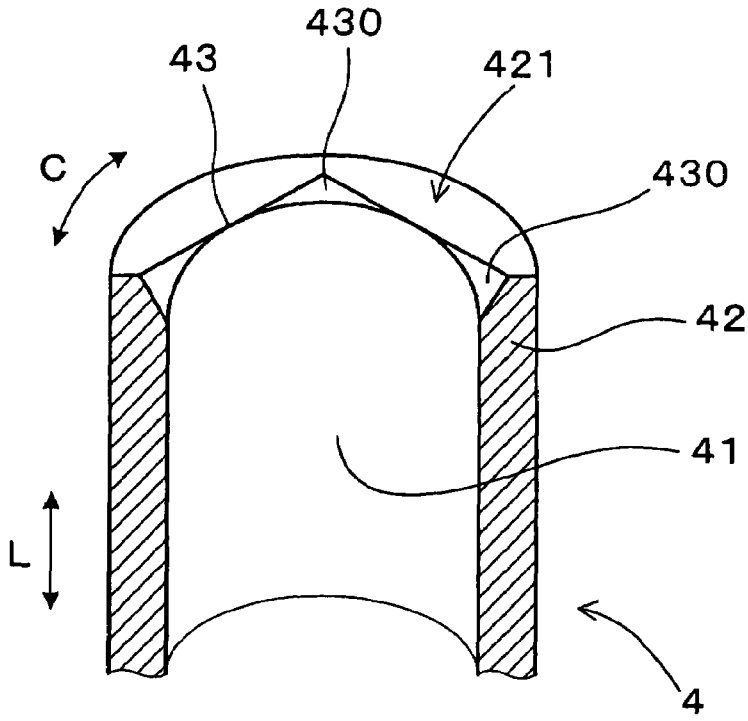
FIG. 9 is a perspective sectional view showing an inner circumferential edge of another plug cap, according to the second embodiment and the seventh embodiment.
Figure 10:
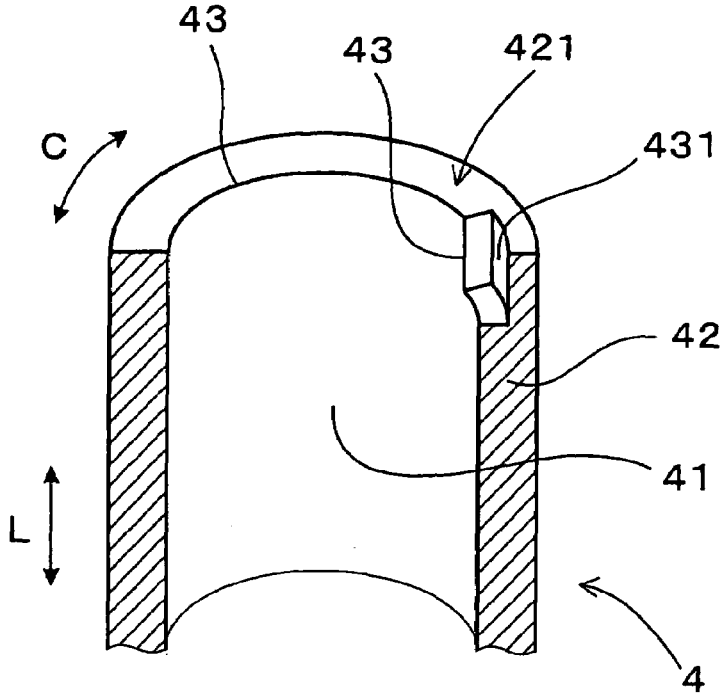
FIG. 10 is a perspective sectional view showing an inner circumferential edge of another plug cap, according to the second embodiment and the seventh embodiment.

As shown in FIG. 9, for example, the inner circumferential edges 43 may have four inclined surfaces 430 each defined by being cut to be in a substantially rhombic shape when being viewed from the axial direction L of the plug cap 4. As shown in FIG. 10, the plug cap 4 may have an inner circumferential edge 43 having therein an inner circumferential groove 431 partially defining the plug-fitting hole 41 with respect to the circumferential direction C. The inner circumferential groove 431 extends from the opening tip end, such that the axial positions of the inner circumferential edge 43 are changed partially with respect to the circumferential direction C.

Each of FIGS. 8 to 10 depicts the cross section of the axial tip end 42 of the plug cap 4. Unillustrated remaining portion is symmetric to the depicted portion.

In this embodiment, the structure other than the above feature is similar to that in the first embodiment, so that the plug cap 4 in this embodiment is capable of producing an effect similarly to the first embodiment.

Third Embodiment

Figure 11:
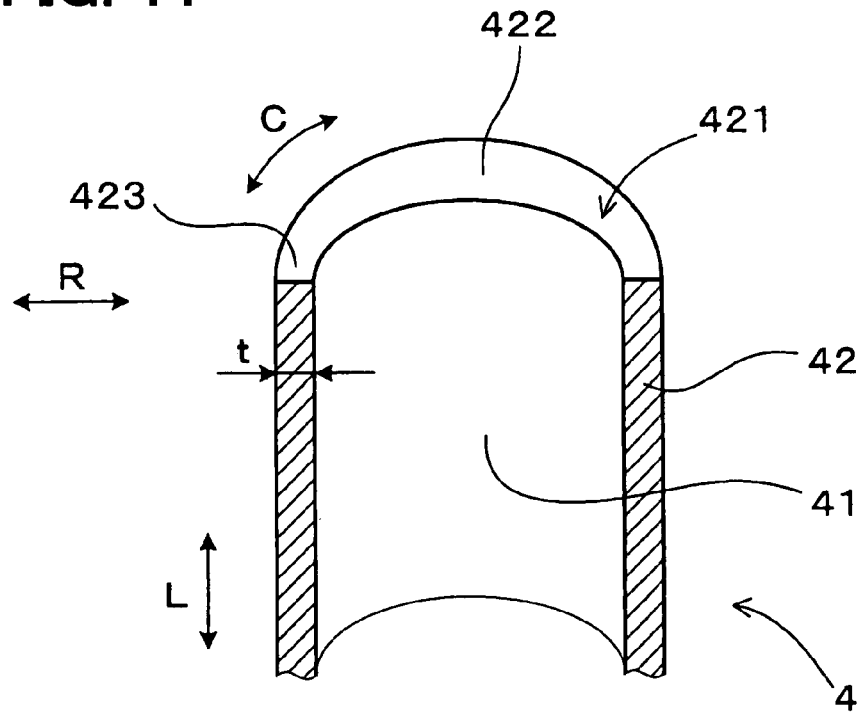
FIG. 11 is a perspective sectional view showing an opening end surface of another plug cap, according to a third embodiment and the seventh embodiment.

As shown in FIG. 11, in this embodiment, the plug cap 4 has the axial tip end 42 having a thickness t with respect to the radial direction R thereof. The thickness t of each circumferential portion of the axial tip end 42 is variously changed with respect to the circumferential direction C.

In this embodiment, the outer circumferential periphery of the axial tip end 42 of the plug cap 4 is in a substantially oval shape when being viewed from the axial direction L of the plug cap 4. The thickness t of the axial tip end 42 with respect of the radial direction R is varied in accordance with the difference between the substantially oval outer circumferential peripheries of a major axis portion 422 and a minor axis portion 423.

In this embodiment, the major axis portion 422 defines a large thickness portion having a large thickness, and the minor axis portion 423 defines a small thickness portion having a small thickness. The insulator 51 of the sparkplug 5 is fitted into the plug-fitting hole 41 of the plug cap 4 of the ignition coil 1. In this condition, fitting resistance caused in the small thickness portion can be reduced compared with fitting resistance caused in the large thickness portion in the axial tip end 42 of the plug cap 4. Therefore, fitting force necessary for the fitting of the insulator 51 can be reduced.

In this embodiment, the shape of the axial tip end 42 of the plug cap 4 has a feature, not the shape of the inner circumferential periphery of the plug-fitting hole 41. Therefore, the ignition coil 1 in this embodiment can be applied to both the sparkplug 5 having the corrugation in the insulator 51 and the sparkplug 5 not having the corrugation in the insulator 51.

In this embodiment, various kinds of sparkplugs 5 can be applied to the ignition coil 1, so that versatility of the ignition coil 1 can be enhanced. In addition, the fitting force applied when the plug cap 4 is fitted to the sparkplug 5 can be reduced.

In this embodiment, the axial tip end 42 of the plug cap 4 may be in various shapes as described below. For example, the axial tip end 42 of the plug cap 4 may include the main portion 420 and a thin portion 424. In this structure, a thickness t of the thin portion 424 with respect to the radial direction R is less than a thickness t of the main portion 420 with respect to the radial direction R. The thin portion 424 may be in a substantially oval shape when being viewed from the axial direction L of the plug cap 4.

Figure 13:
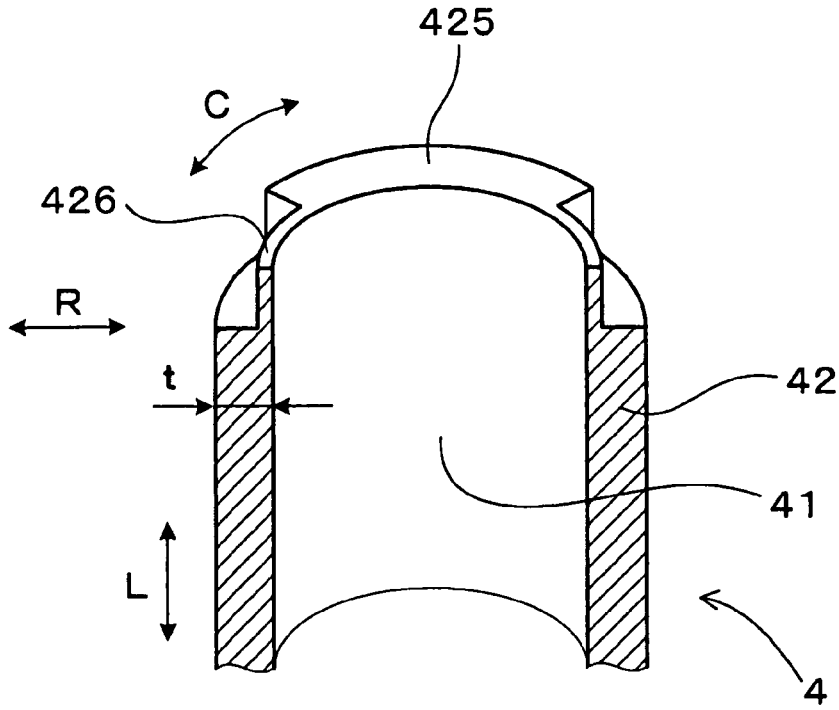
FIG. 13 is a perspective sectional view showing an opening end surface of another plug cap, according to the third embodiment and the seventh embodiment.

As shown in FIG. 13, the axial tip end 42 of the plug cap 4 may be provided with a large thickness circumferential portion 425, which has a large thickness t, and a small thickness circumferential portion 426, which has a small thickness t, by cutting the outer circumferential periphery of the axial tip end 42 partially with respect to the circumferential direction C.

Figure 14:
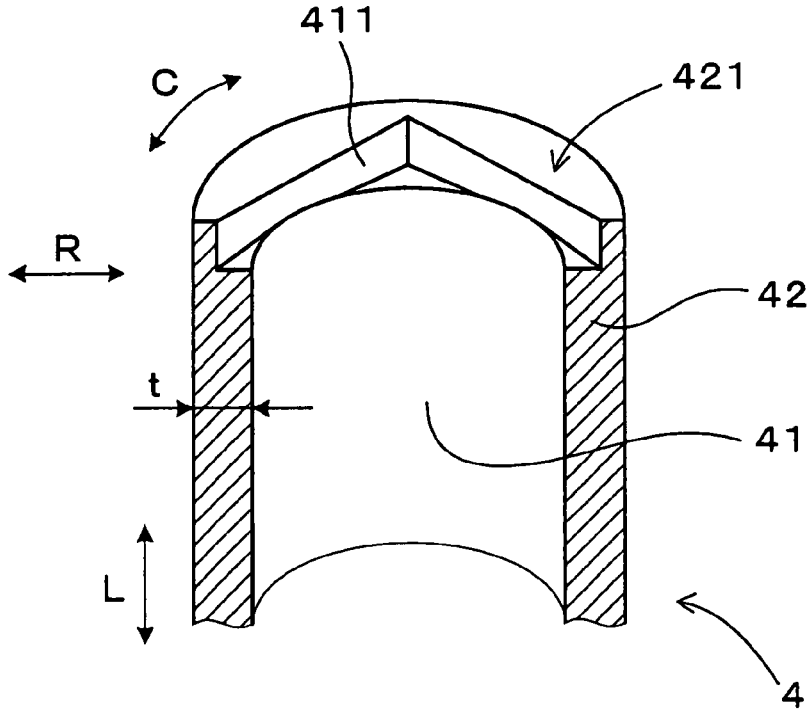
FIG. 14 is a perspective sectional view showing an opening end surface of another plug cap, according to the third embodiment and the seventh embodiment.

As shown in FIG. 14, the axial tip end 42 of the plug cap 4 may have a notch 411 extending from the opening end surface 421 toward the plug-fitting hole 41 with respect to the radial direction R. In this structure, the thickness t of each circumferential portion of the axial tip end 42 is variously changed with respect to the circumferential direction C. The notch 411 may be in a substantially rhombic shape when being viewed from the axial direction L of the plug cap 4.

Each of FIGS. 11 to 14 depicts the cross section of the axial tip end 42 of the plug cap 4. Unillustrated remaining portion is symmetric to the depicted portion.

In this embodiment, the structure other than the above feature is similar to that in the first embodiment, so that the plug cap 4 in this embodiment is capable of producing an effect similarly to the first embodiment.

Fourth Embodiment

Figure 15:
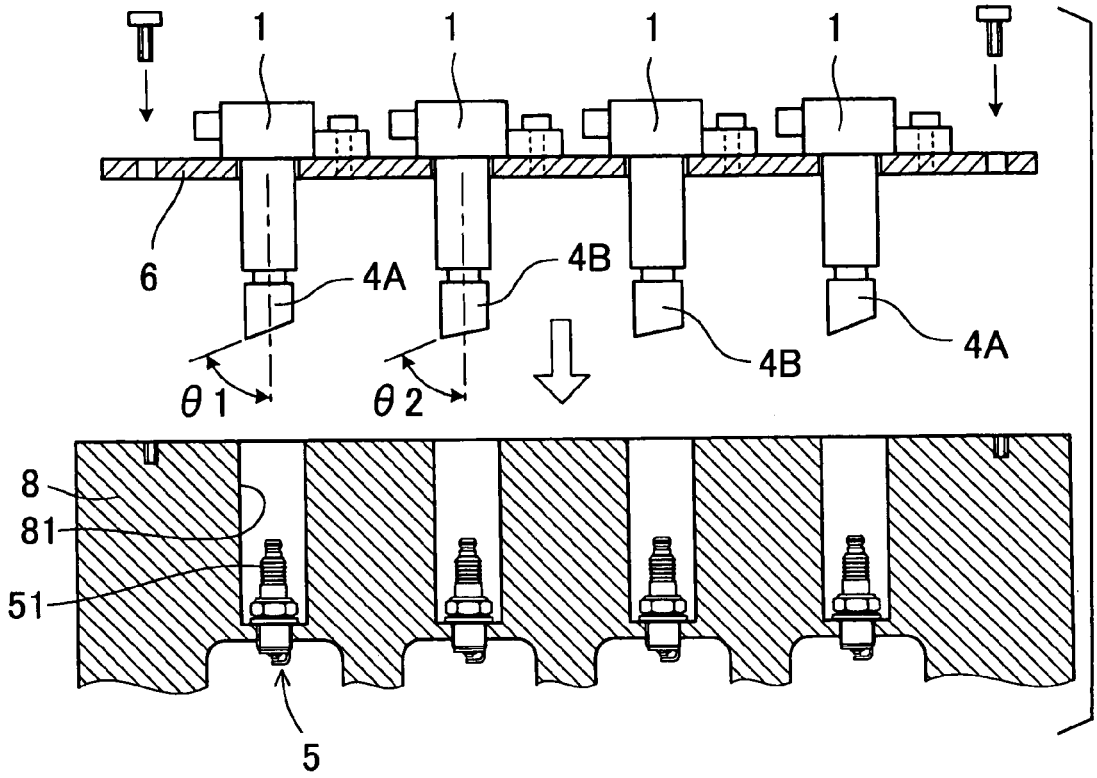
FIG. 15 is a partially sectional view showing ignition coils fitted into plugholes via a base bracket, according to a fourth embodiment.

As shown in FIG. 15, for example, four of the ignition coils 1 are arranged on a base bracket 6. Subsequently, the base bracket 6 is mounted to the engine 8. Sparkplugs 5 are screwed respectively into plugholes 81 of the engine 8. The ignition coils 1 are mounted respectively to the sparkplugs 5.

Each of the plug caps 4 mounted to each of the ignition coils 1 has the opening end surface 421 being inclined. For example, in this embodiment, each of two plug caps 4A on the outer side has the opening end surface 421 inclined by an inclination angle θ1, and each of the other two plug caps 4B on the inner side has the opening end surface 421 inclined by an inclination angle θ2. The inclination angle θ1 is different from the inclination angle θ2.

In this structure, force applied for mounting the ignition coils 1 respectively to the'sparkplugs 5, which are screwed respectively into plugholes 81 of the engine 8, can be effectively reduced. Specifically, the insulator 51 of each of the sparkplugs 5 is inserted into the plug-fitting hole 41 of the plug cap 4 of each of the ignition coils 1. In this condition, peaks of resistance caused in the fitting of the plug caps 4A of the outer two ignition coils 1 are staggered relative to peaks of resistance caused in the fitting of the plug caps 4B of the inner two ignition coils 1. Thus, force applied for simultaneously mounting the ignition coils 1 respectively to the sparkplugs 5 can be effectively reduced.

In this embodiment, the structure other than the above feature is similar to that in the first embodiment, so that the plug cap 4 in this embodiment is capable of producing an effect similarly to the first embodiment.

Fifth Embodiment

Figure 16:
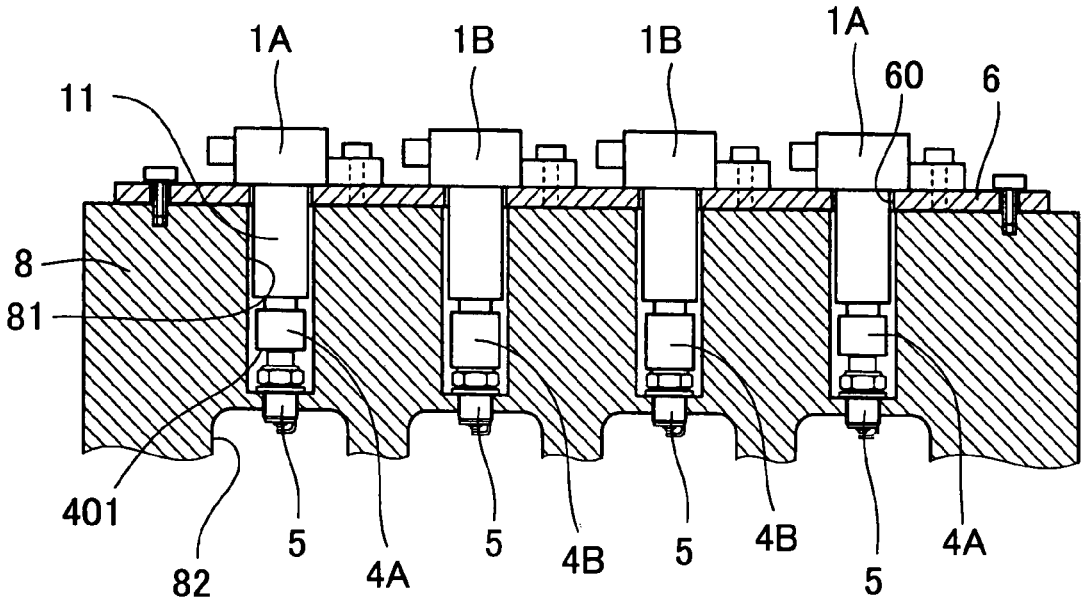
FIG. 16 is a partially sectional view showing a mounting structure of the ignition coils, according to a fifth embodiment.
Figure 17:
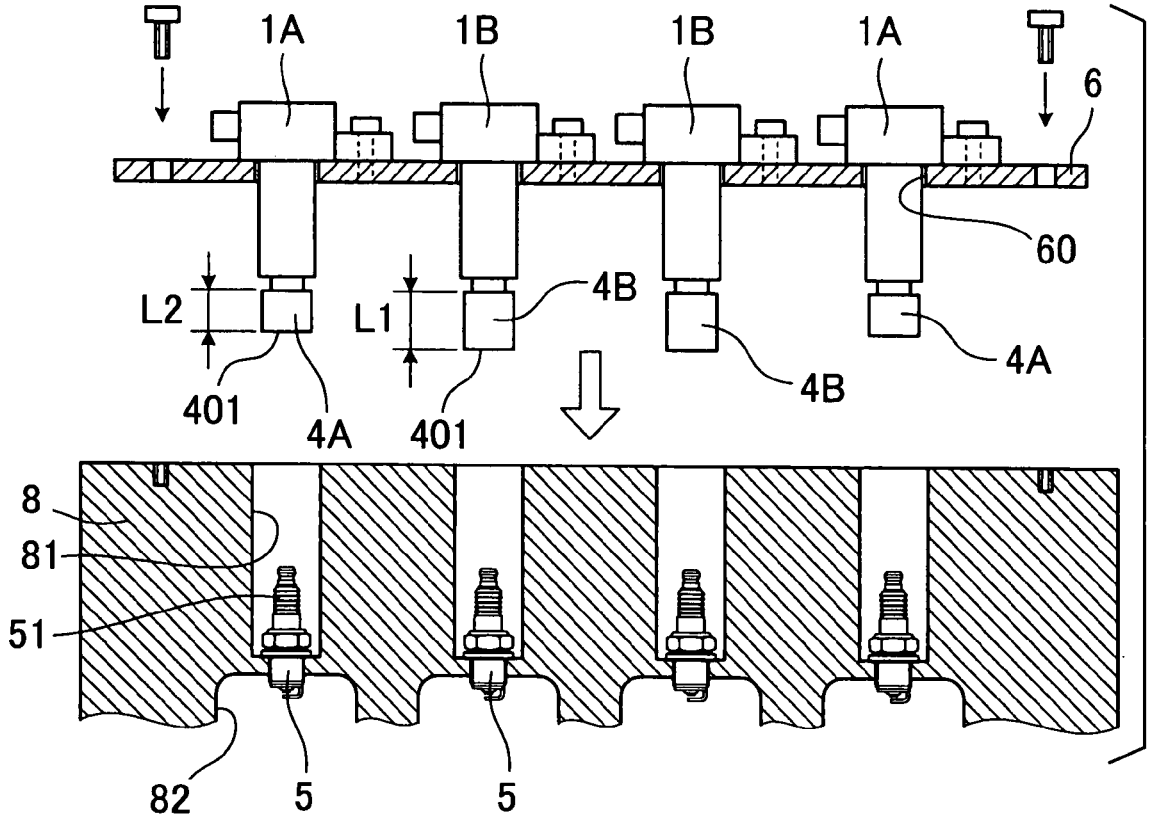
FIG. 17 is a partially sectional view showing the base bracket provided with the ignition coils being mounted to the engine, according to the fifth embodiment.

As shown in FIGS. 16, 17, in this embodiment, a mounting structure for ignition coils 1 is constructed by mounting a base bracket 6, on which the ignition coils 1 are arranged, to the engine 8. In this condition, the ignition coils 1 are mounted respectively to the sparkplugs 5 screwed respectively into plugholes 81 of the engine 8. The mounting structure for the ignition coils 1 constructs a mounting structure for a cassette-type ignition coil device.

Figure 18:
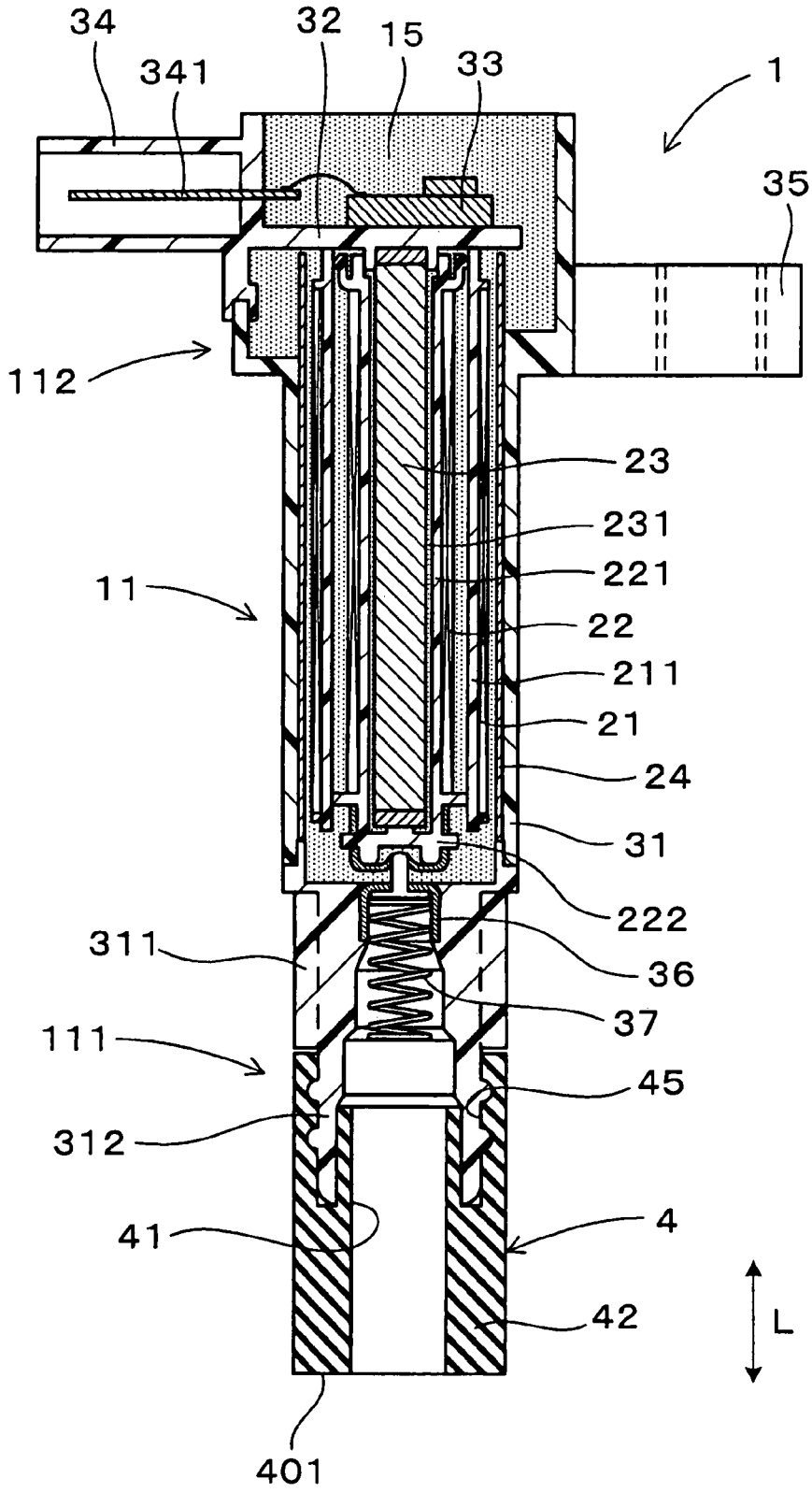
FIG. 18 is a partially sectional view showing one of the ignition coils, according to the fifth embodiment.
Figure 19:
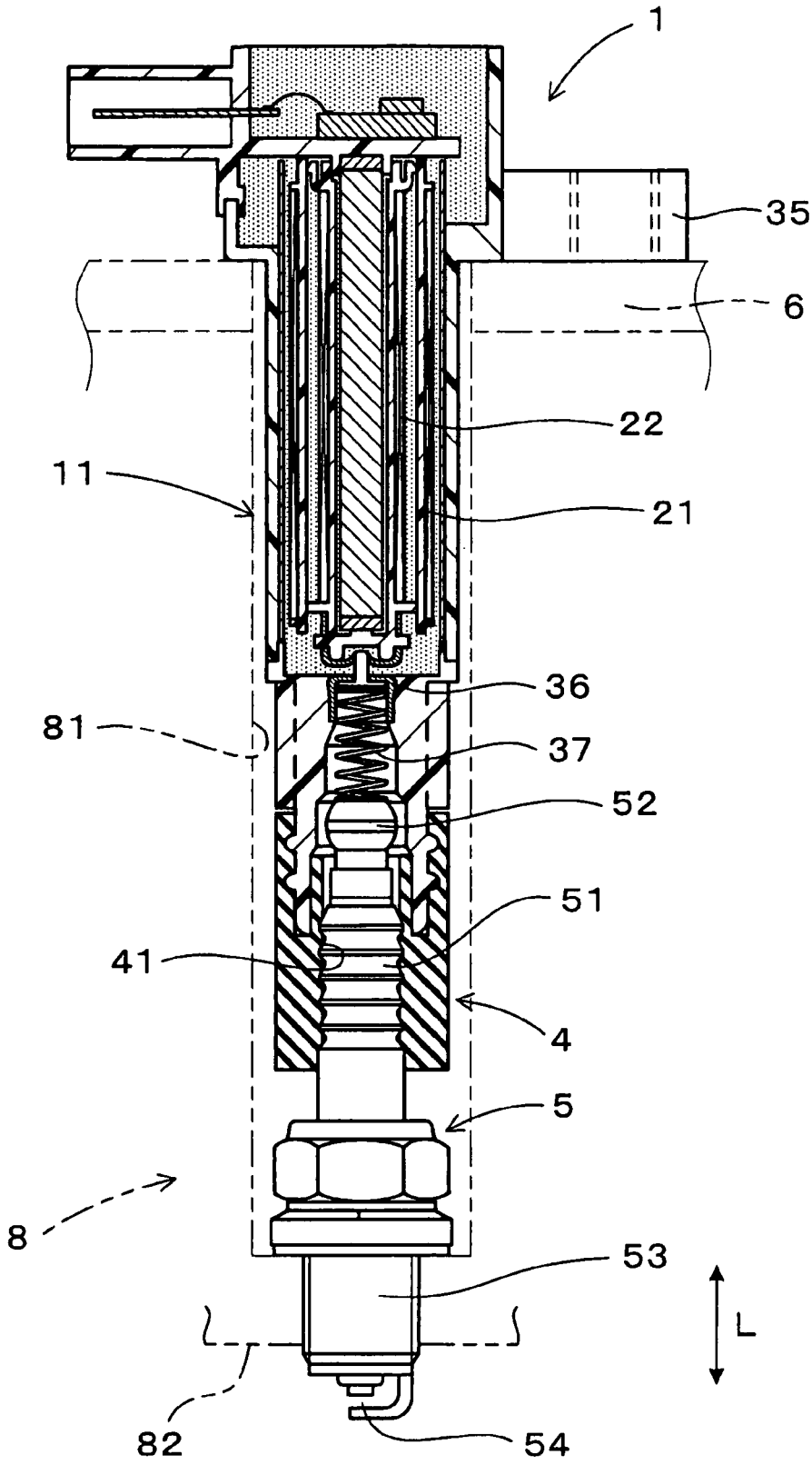
FIG. 19 is a partially sectional view showing the one of the ignition coils fitted into one of the plugholes of the engine, according to the fifth embodiment.

As shown in FIGS. 18, 19, each of the ignition coils 1 includes the coil body 11 having the primary coil 21 and the secondary coil 22. The coil body 11 has an axial end 111 provided with a plug cap 4 formed of rubber being electrically insulative and waterproof. An insulator 51 of each of the sparkplugs 5 is fitted into the plug-fitting hole 41 of each of the plug caps 4.

Referring to FIGS. 16, 17, in this embodiment, at least one of the multiple plug caps 4 extends to an axial end position 401, which is different from an axial end position 401 to which the other at least one of the multiple plug caps 4 extends, in this mounting structure of the ignition coils 1.

As follows, the mounting structure for the ignition coils 1 of this embodiment is described with reference to FIGS. 16 to 22.

As shown in FIGS. 16, 19, each of the ignition coils 1 is a stick-type coil having the coil body 11 constructed of the primary coil 21 and the secondary coil 22. Each coil body 11 is inserted into each plughole 81 in a cylinder head cover of the engine 8.

As shown in FIG. 18, the primary coil 21 includes the primary spool 211, which is a cylindrical resin member, and a primary wire, which is applied with an electrically insulative coating. The primary coil 21 is constructed by winding the primary wire around the outer circumferential periphery of the primary spool 211 by a primary winding number. The secondary coil 22 includes the secondary spool 221, which is a cylindrical resin member, and a secondary wire, which is applied with an electrically insulative coating. The secondary coil 22 is constructed by winding the secondary wire around the outer circumferential periphery of the secondary spool 221 by a secondary winding number, which is greater than the primary winding number. The secondary coil 22 is arranged on the radially inner side of the primary coil 21. The center core 23 is arranged on the radially inner side of the secondary coil 22. The center core 23 is formed of a magnetic material. The primary coil 21 is arranged in the coil case 31, which is a cylindrical resin member. The outer core 24 is provided on the radially outer side of the coil case 31. The primary spool 211 and the secondary spool 221 are formed of thermoplastic resin.

The center core 23 is constructed by stacking substantially flat electromagnetic steel plates such as silicon steel plates applied with an electrically insulative coating. Each of the steel plates defines the axial section of the center core 23 perpendicular to the axial direction L of the ignition coil 1. The outer core 24 is constructed of multiple substantially cylindrical electromagnetic steel plates such as silicon steel plates having at least one silt (gap) with respect to the axial direction L. The electromagnetic steel plates are stacked with respect to the radial direction R via adhesion bond to construct the outer core 24. The center core 23 and the outer core 24 are capable of defining therebetween a magnetic path through which magnetic flux is formed by supplying electricity to the primary coil 21. A stress relaxation tape 231 is wound around the outer circumferential periphery of the center core 23.

Referring to FIG. 18, the coil body 11 has the other axial end 112 provided with the igniter case 32 fitted to the coil case 31. The igniter case 32 is provided with the igniter 33 for supplying electricity to the primary coil 21.

The igniter case 32, includes the connector portion 34. The electrically conductive pins 341 are insert-molded in the connector portion 34 such that the electrically conductive pins 341 radially outwardly extend. The igniter 33 includes electrically conductive pins, which are respectively conductive with the electrically conductive pins 341 of the connector portion 34. The other axial end of the coil case 31 includes the flange portion 35 radially outwardly extending. The ignition coil 1 is mounted to the engine 8 via the flange portion 35.

The igniter 33 includes an electric power control circuit including a switching element or the like operated by a signal transmitted from an engine control unit (ECU). The igniter 33 further includes an ion current detecting circuit for detecting ion current.

In this embodiment, the one axial end of the coil case 31 is connected with the plug base portion 311 to be attached with the plug cap 4. The plug base portion 311 has the annular protrusion 312 fitted into an annular recession 45 of the plug cap 4.

The one axial end of the secondary spool 221 has the extended portion 222. The extended portion 222 and the plug base portion 311 therebetween interpose the secondary terminals (high voltage terminals) 36 electrically conductive with a high voltage winding end of the secondary coil 22. The spring 37 is provided radially inner side of the plug base portion 311. The spring 37 is electrically conductive with the secondary terminal 36.

Referring to FIG. 19, the sparkplug 5 has an electrically conductive terminal portion 52. The sparkplug 5 is fitted into the plug-fitting hole 41 of the plug cap 4 in a condition where the electrically conductive terminal portion 52 is in contact with the spring 37.

Referring to FIG. 18, the coil case 31 and the igniter case 32 therebetween define a cavity into which the thermosetting resin 15 such as epoxy resin is charged.

The thermosetting resin 15 is charged into the case 3. Specifically, the thermosetting resin 15 is charged into the cavity between the tape 231 around the outer circumferential periphery of the center core 23 and the secondary spool 221. The thermosetting resin 15 is further charged into gaps in a secondary winding constructing the secondary coil 22 and the cavity between the secondary coil 22 and the primary spool 211. The thermosetting resin 15 is further charged into gaps in a primary winding constructing the primary coil 21 and the cavity between the primary coil 21 and the outer core 24. The thermosetting resin 15 is further charged into the cavity between the outer core 24 and the case 3.

In the ignition coil 1, the ECU outputs a pulse-shaped spark-generating signal to the igniter 33, so that the electric power control circuit of the igniter 33 is activated. Electricity is supplied to the primary coil 21, so that the center core 23 and the outer core 24 form therebetween a magnetic field. The ECU terminates the electricity supplied to the primary coil 21, so that the center core 23 and the outer core 24 form therebetween an inductive magnetic field opposite to the magnetic field. The inductive magnetic field generates induced electromotive force (counter electromotive force) in the secondary coil 22, so that the sparkplug provided to the ignition coil 1 sparks.

FIG. 19 depicts an example of the sparkplug 5 applied to the ignition coil 1 in this embodiment. The sparkplug 5 includes the insulator 51, the electrically conductive terminal portion 52, the screw portion 53, and the pair of electrode portions 54. The insulator 51 includes the multiple annular protrusions 511 arranged in parallel with each other with respect to the axial direction L, so that the insulator 51 forms a corrugation. The electrically conductive terminal portion 52 is provided in the other axial end of the insulator 51. The screw portion 53 extends from the insulator 51 toward the one axial end. The screw portion 53 is adapted to being screwed to the engine 8. The pair of electrode portions 54 is provided to the one axial end of the screw portion 53.

Figure 20:
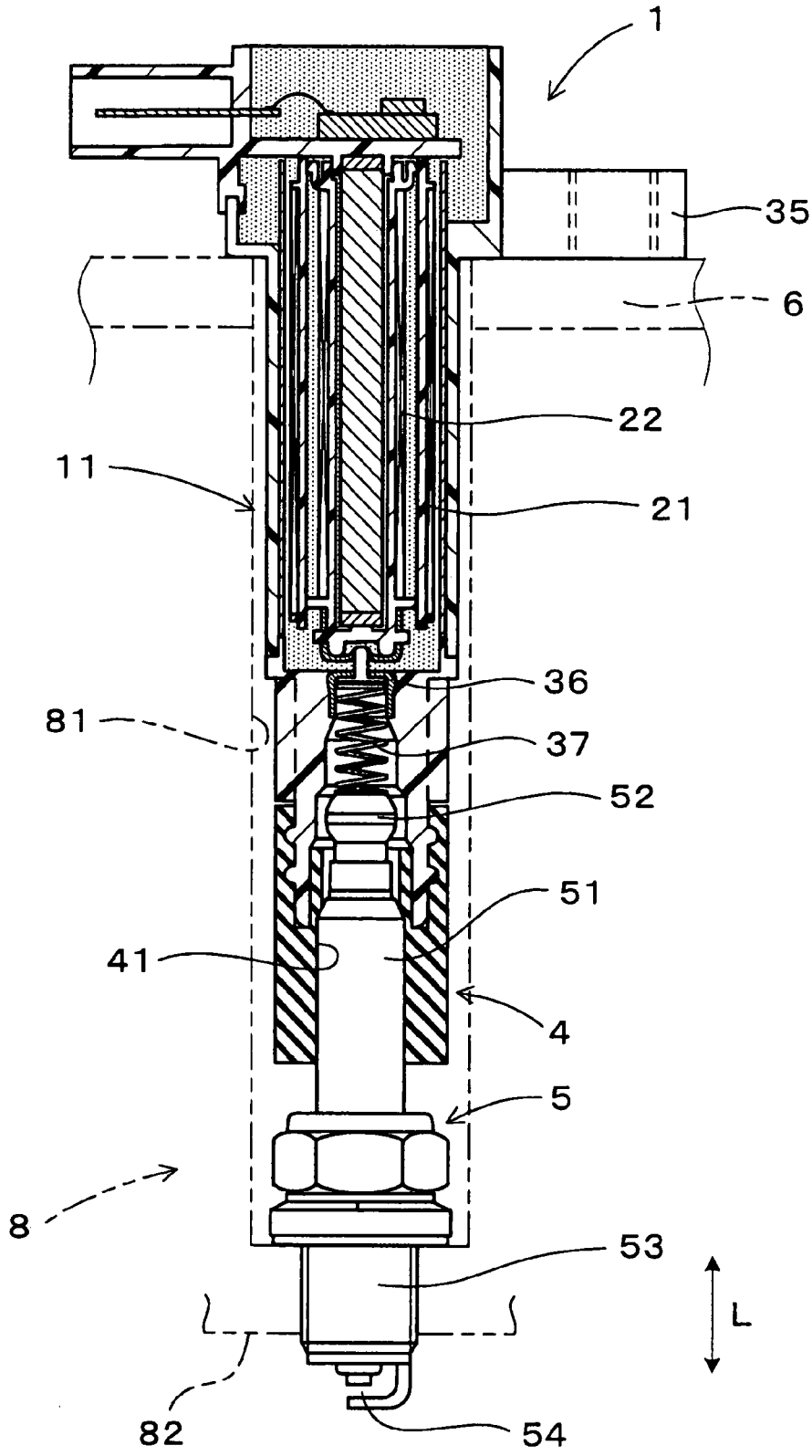
FIG. 20 is a partially sectional view showing the ignition coil fitted into the plughole screwed with another sparkplug, according to the first embodiment.

As shown in FIG. 20, the sparkplug 5 may be provided with an insulator 51 without the annular protrusions 511, i.e., without the corrugation.

Referring to FIGS. 16, 17, in this embodiment, the base bracket 6 is an elongated plate extended in a direction along which the ignition coils 1 are arranged. The base bracket 6 has multiple insertion holes 60 arranged along the elongated direction of the base bracket 6. The ignition coils 1, which are laterally arranged with each other, are respectively inserted into the insertion holes 60.

In this embodiment, the engine 8 is an inline four-cylinder engine. Four of the ignition coils 1 are laterally arranged on the base bracket 6. Four of the plugholes 81 are laterally arranged in the engine 8. Referring to FIG. 19, each of the plugholes 81 has a bottom portion screwed with the screw portion 53 of the sparkplug 5. The pair of each of the sparkplugs 5 is protruded into the corresponding combustion chamber 82 of the engine 8.

Referring to FIG. 17, in this embodiment, each of two plug caps 4A on the inner side has an axial length L1, and each of the other two plug caps 4B on the outer side has an axial length L2. The axial length L1 is different from the axial length L2. In this structure, the axial end position 401 of each of two plug caps 4A on the outer side is different from the axial end position 401 of each of two plug caps 4B on the inner side. In this embodiment, the axial length L1 of each of two plug caps 4A on the outer side is greater than the axial length L2 of each of two plug caps 4B on the inner side.

Preferably, the axial end position 401 of each of two plug caps 4A on the outer side is different from the axial end position 401 of each of two plug caps 4B on the inner side by 1 mm or greater. Further preferably, the axial end position 401 of each of two plug caps 4A is different from the axial end position 401 of each of two plug caps 4B by 2 mm or greater. In consideration of the length of the plug caps 4, the axial end position 401 of each of two plug caps 4A on the outer side is different from the axial end position 401 of each of two plug caps 4B on the inner side, preferably by 5 mm or greater.

Referring to FIG. 17, in this embodiment, the four ignition coils 1 are mounted respectively to the sparkplugs 5 each screwed into the corresponding plughole 81. Specifically, the four ignition coils 1 are mounted to the base bracket 6 using coil-screws or the like, and subsequently, the base bracket 6 is mounted to the engine 8 all together. In this condition, the plug-fitting hole 41 of the plug cap 4B of each of two ignition coils 1B on the inner side makes contact with the corresponding insulator 51 of the sparkplug 5 prior to the plug-fitting hole 41 of the plug cap 4A of each of two ignition coils 1A on the outer side.

In this structure, the fitting of the insulators 51 of the sparkplugs 5 into the plug-fitting holes 41 of the plug caps 4 are conducted primarily from the plug-fitting holes 41 of the plug caps 4B of the two ignition coils 1B on the inner side. The starting of the fitting of the ignition coils 1B on the inner side is staggered with respect to the starting of the fitting of the ignition coils 1A on the outer side. Therefore, the peaks of fitting force respectively applied to the four ignition coils 1 can be staggered in the structure in which the four ignition coils 1 are simultaneously mounted to the four sparkplugs 5. Thus, the fitting force applied when the four ignition coils 1 are fitted can be reduced.

In this embodiment, the axial end positions 401 of the plug caps 4 have a feature, not the shape of the inner circumferential periphery of each plug-fitting hole 41. Therefore, the ignition coil 1 in this embodiment can be applied to both the sparkplug 5 having the corrugation in the insulator 51 and the sparkplug 5 not having the corrugation in the insulator 51.

In this embodiment, various kinds of sparkplugs 5 can be applied in the mounting structure in which the multiple ignition coils 1 are substantially simultaneously mounted respectively to the multiple sparkplugs 5. In addition, the fitting force applied when the ignition coils 1 are fitted to the sparkplugs 5 can be reduced.

Figure 21:
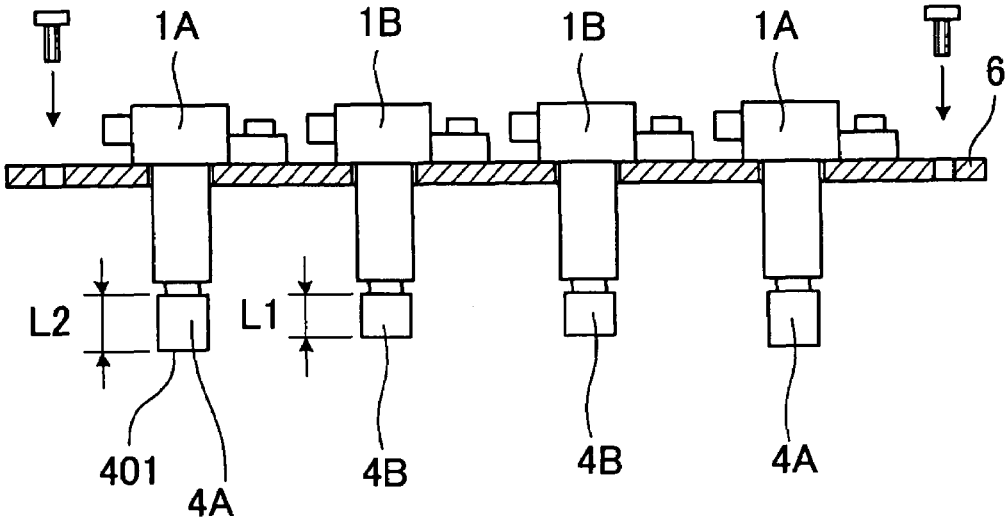
FIG. 21 is a partially sectional view showing other ignition coils provided to the base bracket, according to the fifth embodiment.

The axial length of each of the plug caps 4 can be determined to being different from each other, as appropriate. For example, as shown in FIG. 21, the axial length L1 of each of two plug caps 4A on the inner side may be less than the axial length L2 of each of two plug caps 4B on the outer side.

As described below, an axial length 401 of at least one of the plug caps 4 can be staggered from the axial length 401 of each of the other plug caps 4 by modifying the shape of the base bracket 6, in addition to the structure in which the axial length of each of the plug cap 4 is different from each other.

Figure 22:
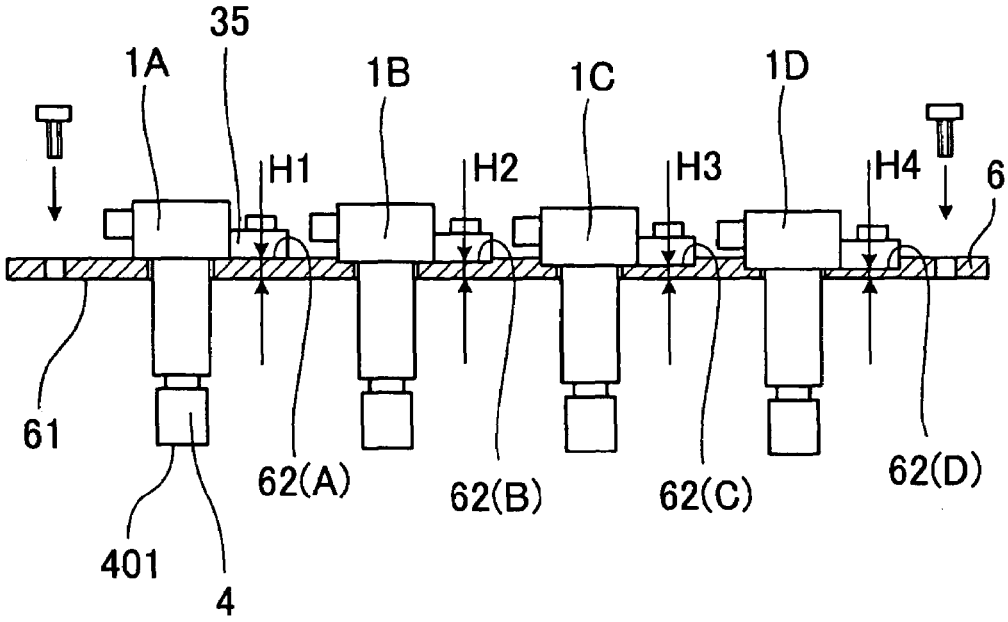
FIG. 22 is a partially sectional view showing the ignition coils provided to another base bracket, according to the fifth embodiment.

Specifically, as shown in FIG. 22, the base bracket 6 has one surface defining a backside reference surface 61 to be opposed to the engine 8. The base bracket 6 has the other surface defining four frontside mounting surfaces 62 opposed respectively to mount portions (flange portions 35) of the ignition coils 1. The distance between at least one of the four frontside mounting surfaces 62 and the backside reference surface 61 is different from the distance between the other of the four frontside mounting surfaces 62 and the backside reference surface 61.

In this structure, the axial end position 401 of at least one of the plug caps 4 is different from the axial end positions 401 of the other plug caps 4 in a condition where the four ignition coils 1 are mounted to the base bracket 6 by mounting the flange portions 35 correspondingly to the frontside mounting surfaces 62.

First frontside mounting surface 62A, which is in the one outermost end of the base bracket 6, defines a distance HI with respect to the backside reference surface 61. Second frontside mounting surface 62B, which is adjacent to the first frontside mounting surface 62A, defines a distance H2 with respect to the backside reference surface 61. Third frontside mounting surface 62C, which is adjacent to the second frontside mounting surface 62B, defines a distance H3 with respect to the backside reference surface 61. Fourth frontside mounting surface 62D, which is adjacent to the third frontside mounting surface 62C, defines a distance H4 with respect to the backside reference surface 61. The distance H2 is less than the distance H1. The distance H3 is less than the distance H2. The distance H4 is less than the distance H3.

In this structure, the fitting of the insulators 51 of the sparkplugs 5 respectively into the plug-fitting holes 41 of the plug caps 4 is started primarily from the plug cap 4 of the fourth ignition coil 1D, which is mounted to the fourth frontside mounting surface 62D. Subsequently, the fitting of the plug cap 4 of the third ignition coil 1C, the fitting of the plug cap 4 of the second ignition coil 1B, and the fitting of the plug cap 4 of the first ignition coil 1A, are started sequentially in this order. The timings of the fitting of the ignition coils 1 are staggered with respect to each other. This structure is also capable of producing an effect similar to the above effect.

As unillustrated, the total length of the insulator 51 of the sparkplug 5 screwed to one of the plugholes 81 is different from the total length of the insulator 51 each of the sparkplugs 5 screwed to the other of the plugholes 81.

The height of the screwed portion of the sparkplug 5 in the bottom portion of at least one of the plugholes 81 is different from the height of the screwed portion of the sparkplug 5 in the bottom portion of each of the other of the plugholes 81.

In this structure, the total length of the coil body 11 of at least one of the ignition coils 1 is different from the total length of each coil body 11 of the other of the ignition coils 1.

Sixth Embodiment

Figure 23:
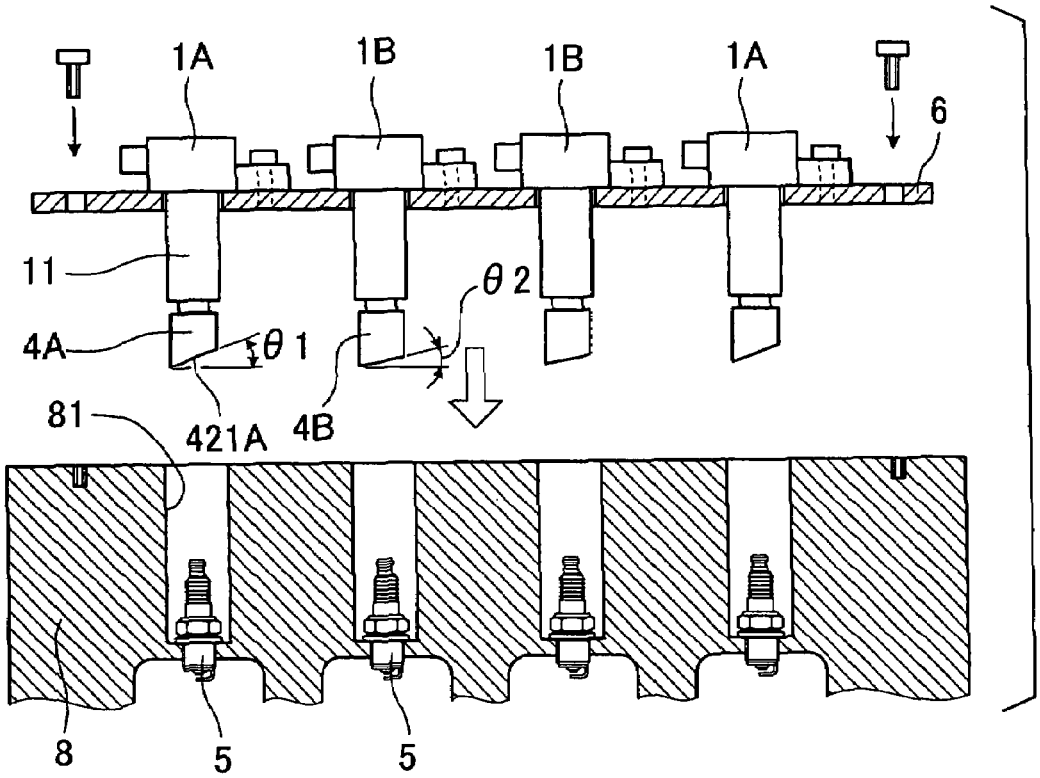
FIG. 23 is a partially sectional view showing the base bracket provided with the ignition coils being mounted to the engine, according to a sixth embodiment.

Referring to FIGS. 19, 23, the multiple plug caps 4 of the multiple ignition coils 1 respectively have the axial end surfaces 421A each defining the inclined surface. At least one of the axial end surfaces 421A is inclined by the inclination angle θ being different from the inclination angle θ of each of the axial end surfaces 421A of the other plug caps 4.

Each of two plug caps 4A on the outer side has the axial end surface 421A inclined by the inclination angle θ1, and each of the other two plug caps 4B on the inner side has the axial end surface 421A inclined by the inclination angle θ2. The inclination angle θ1 is different from the inclination angle θ2.

For example, each of two plug caps 4A on the outer side has the axial end surface 421A inclined by the inclination angle θ1 being 45° with respect to a plane perpendicular to the center axis of the plug cap 4. Each of the other two plug caps 4B on the inner side has the axial end surface 421A inclined by the inclination angle θ2 being 30° with respect to the plane perpendicular to the center axis of the plug cap 4.

The inclination angle θ of the axial end surface 421A may be in a range between 2° and 30° with respect to the plane perpendicular to the center axis of the plug cap 4.

In this embodiment, the axial end surface 421A of each of the plug caps 4 is entirely inclined to one side to define the inclined surface. The axial end surface 421A has circumferential portions with respect to the circumferential direction C. The axial positions of the circumferential portions of the axial end surface 421A are continuously and gradually changed.

In this embodiment, the four ignition coils 1 are mounted respectively to the sparkplugs 5 each screwed into the corresponding plughole 81. Specifically, the four ignition coils 1 are mounted to the base bracket 6 using coil-screws or the like, and subsequently, the base bracket 6 is mounted to the engine 8 all together. In this condition, the insulator 51 of each of the sparkplugs 5 is fitted into the plug-fitting hole 41 of each of the plug caps 4.

Peaks of resistance caused in the fitting of the plug caps 4A of the outer two ignition coils 1A and peaks of resistance caused in the fitting of the plug caps 4B of the inner two ignition coils 1B are different from each other. That is, peaks of resistance caused in the fitting of the plug caps 4A of the outer two ignition coils 1A are staggered relative to peaks of resistance caused in the fitting of the plug caps 4B of the inner two ignition coils 1B. In this structure, the fitting force applied when the four ignition coils 1 are fitted can be reduced in the structure in which the four ignition coils 1 are simultaneously mounted to the four sparkplugs 5.

In this embodiment, the structure other than the above feature is similar to that in the fifth embodiment, so that the plug cap 4 in this embodiment is capable of producing an effect similarly to the fifth embodiment.

Seventh Embodiment

In this embodiment, the axial tip end 42 of the plug cap 4 of each of the ignition coils 1 has features in addition to the structures in the fifth and sixth embodiments.

These features in this embodiment can be applied to the plug cap 4 of each of the ignition coils 1 described in the fifth and sixth embodiments.

For example, referring to FIG. 5, the axial end surface 421A of the plug cap 4 may be defined by forming the multiple inclined surfaces 421B, which are repeatedly formed with respect to the circumferential direction C. In this structure, the inclination angle of the inclined surface 421B of at least one of the plug caps 4 may be different from the inclination angle of the inclined surface 421B of each of the other plug caps 4.

As shown in FIG. 6, the axial end surface 421A of the plug cap 4 may have a stepwise surface defining the protrusions 421C partially with respect to the circumferential direction C. Each of the protrusions 421C protrudes with respect to the axial direction L. In this structure, the depth of a recessed groove 421D, which is recessed relative to each protrusion 421C, of at least one of the plug caps 4 may be different from the depth of the recessed groove 421D of the other of each of the plug caps 4.

As shown in FIG. 7, each protrusion 421C may have a thickness t1, which is less than a thickness t0 of the main portion 420 of the axial tip end 42.

Next, an example, in which the plug cap 4 has an inner circumferential edge 43 defining therein the plug-fitting hole 41, is described. The axial positions of the inner circumferential edge 43 are variously changed with respect to the circumferential direction C. This feature in this embodiment can be applied to the plug cap 4 of each of the ignition coils 1 described in the fifth embodiment.

Referring to FIG. 8, in this embodiment, the inner circumferential edge 43 of the plug-fitting hole 41 has an inclined surface defined by being partially cut. In this structure, each of the inner circumferential edge 43 has the inclined surface 430 defined by being cut to be in a substantially oval shape when being viewed from the axial direction L of the plug cap 4. Two of the inner circumferential edges 43 are formed to be opposed to each other.

In this structure, the depth (inclination angle) of the inclined surface 430 of at least one of the plug caps 4 may be different from the depth of the inclined surface 430 of the other of each of the plug caps 4.

As shown in FIG. 9, for example, the inner circumferential edges 43 may have four inclined surfaces 430 each defined by being cut to be in a substantially rhombic shape when being viewed from the axial direction L of the plug cap 4.

As shown in FIG. 10, the plug cap 4 may have an inner circumferential edge 43 having therein the inner circumferential groove 431 partially defining the plug-fitting hole 41 with respect to the circumferential direction C. The inner circumferential groove 431 extends from the opening tip end, such that the axial positions of the inner circumferential edge 43 are changed partially with respect to the circumferential direction C. In this structure, the depth of the inner circumferential groove 431 of at least one of the plug caps 4 may be different from the depth of the inner circumferential groove 431 of the other of each of the plug caps 4.

Next, an example, in which the thickness t of each circumferential portion of the axial tip end 42 is variously changed with respect to the circumferential direction C, is described. This feature in this embodiment can be applied to the plug cap 4 of each of the ignition coils 1 described in the fifth embodiment.

For example, as shown in FIG. 11, the outer circumferential periphery of the axial tip end 42 of the plug cap 4 is in a substantially oval shape when being viewed from the axial direction L of the plug cap 4. In this structure, the thickness t of the axial tip end 42 with respect of the radial direction R is varied in accordance with the difference between the substantially oval outer circumferential peripheries of the major axis portion 422 and the minor axis portion 423. In this structure, an average thickness, relative to the radial direction R, of the axial tip end 42 of at least one of the plug caps 4 may be different from the average thickness, relative to the radial direction R, of the axial tip end 42 of the other of each of the plug caps 4.

Figure 12:
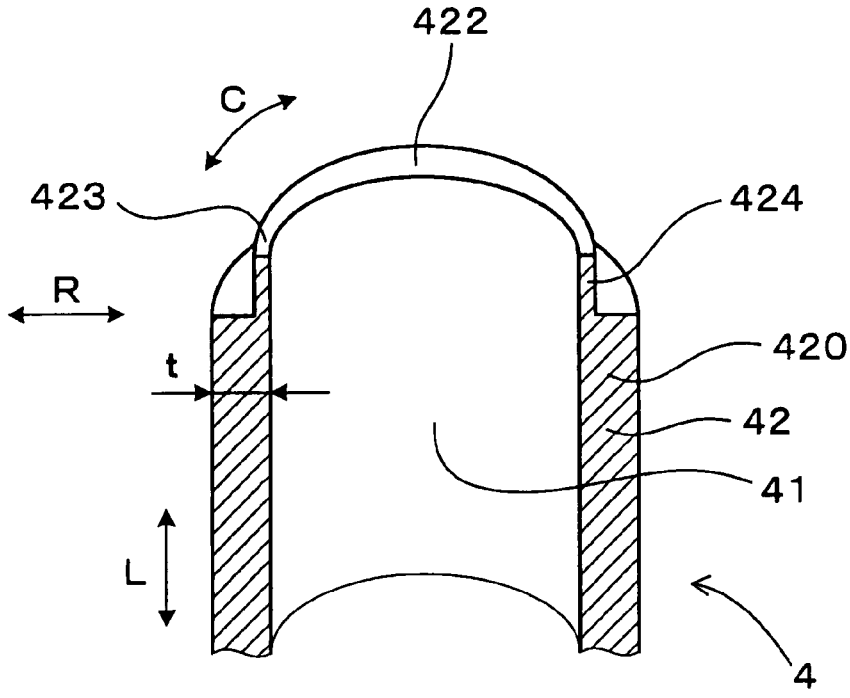
FIG. 12 is a perspective sectional view showing an opening end surface of another plug cap, according to the third embodiment and the seventh embodiment.

As shown in FIG. 12, the axial tip end 42 of the plug cap 4 may include the main portion 420 and the thin portion 424. In this structure, a thickness t of the thin portion 424 with respect to the radial direction R is less than a thickness t of the main portion 420 with respect to the radial direction R. The thin portion 424 may be in a substantially oval shape when being viewed from the axial direction L of the plug cap 4. In this structure, dimensions such as the depth and the thickness of the thin portion 424 of at least one of the plug caps 4 may be different from the dimensions such as the depth and the thickness of the thin portion 424 of the other of each of the plug caps 4.

As shown in FIG. 13, the axial tip end 42 of the plug cap 4 may be provided with the large thickness circumferential portion 425, which has the large thickness t, and the small thickness circumferential portion 426, which has the small thickness t, by cutting the outer circumferential periphery of the axial tip end 42 partially with respect to the circumferential direction C. In this structure, the circumferential length of the large thickness circumferential portion 425, which has the large thickness t relative to the radial direction R, of at least one of the plug caps 4 may be different from the circumferential length of the large thickness circumferential portion 425 of the other of each of the plug caps 4. That is, the length of the large thickness circumferential portion 425 relative to the entire circumference of the axial tip end 42 of at least one of the plug caps 4 may be different from the length of the large thickness circumferential portion 425 relative to the entire circumference of the axial tip end 42 of the other of each of the plug caps 4.

Furthermore, as shown in FIG. 14, the axial tip end 42 of the plug cap 4 may have the notch 411 extending from the axial end surface 421A toward the plug-fitting hole 41 with respect to the radial direction R. The thickness t of each circumferential portion of the axial tip end 42 is variously changed with respect to the circumferential direction C. The notch 411 may be in a substantially rhombic shape to define a substantially rectangular hole when being viewed from the axial direction L of the plug cap 4. In this structure, the depth of the notch 411 of at least one of the plug caps 4 may be different from the depth of the notch 411 of the other of each of the plug caps 4.

As unillustrated, the outer diameter of the axial tip end 42 of at least one of the plug caps 4 may be different from the outer diameter of the axial tip end 42 of each of the other plug caps 4.

In this structure, the material of at least one of the plug caps 4 may be different from the material of each of the other plug caps 4. In this structure, the roughness of the surface defining the plug-fitting hole 41 of at least one of the plug caps 4 may be different from the roughness of the surface defining the plug-fitting hole 41 of each of the other plug caps 4.

In this embodiment, the structure other than the above feature is similar to those in the fifth and sixth embodiments, so that the plug cap 4 in this embodiment is capable of producing an effect similarly to the fifth and sixth embodiments.

Eighth Embodiment

Figure 24:
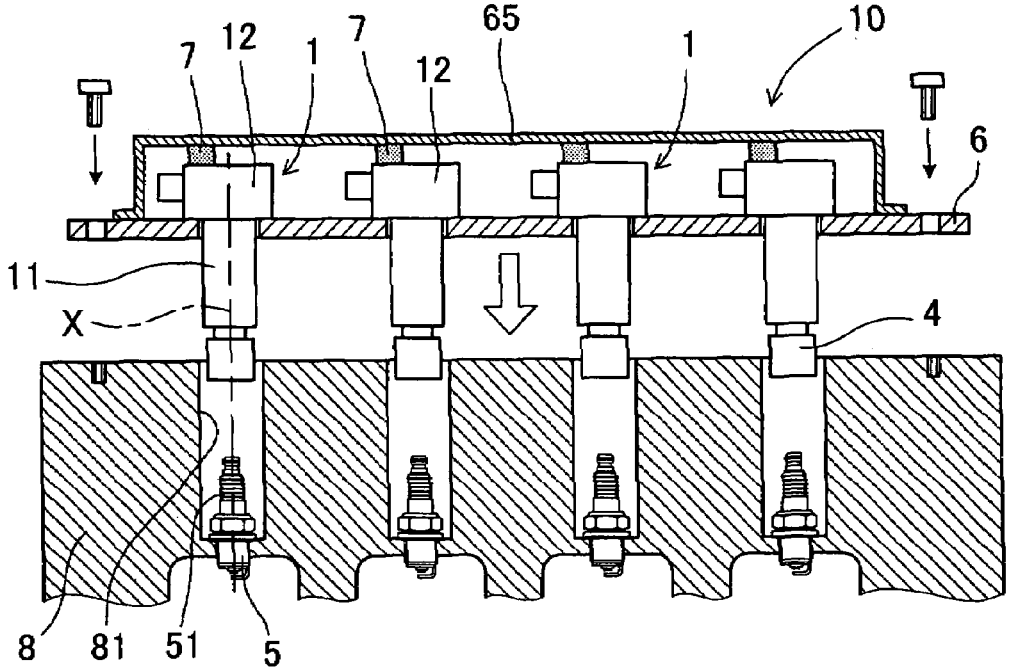
FIG. 24 is a partially sectional view showing a pre-assembly, which includes the base bracket provided with the ignition coils, being mounted to the engine, according to an eighth embodiment.
Figure 25:
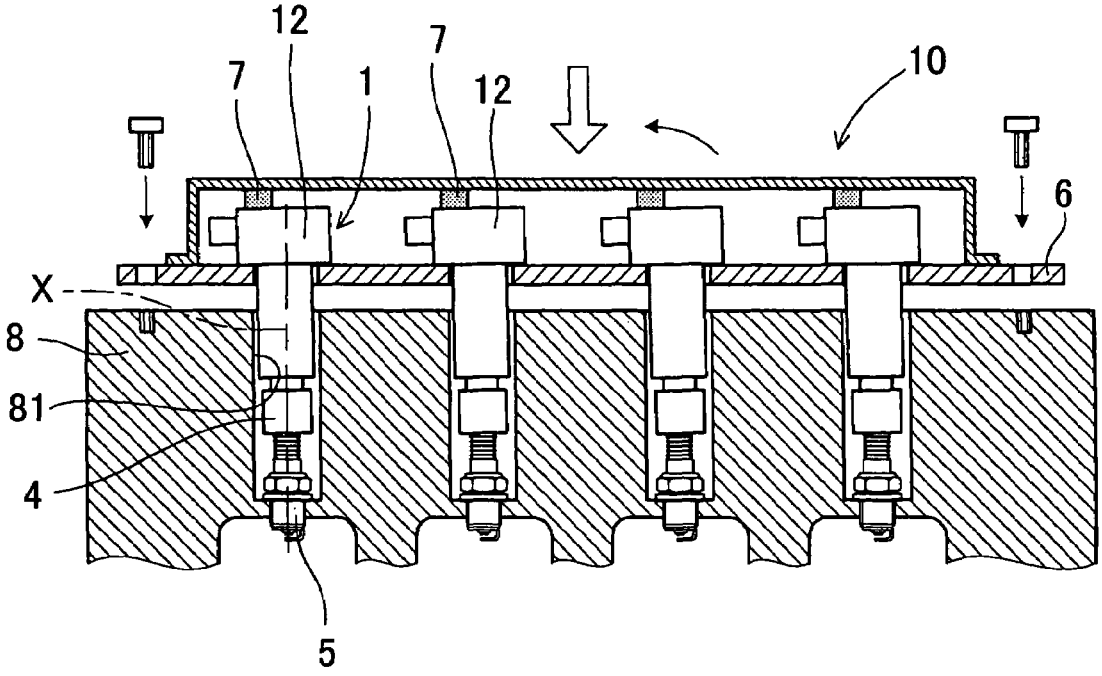
FIG. 25 is a partially sectional view showing the pre-assembly including the base bracket provided with the ignition coils each inclined when being mounted to the engine, according to the eighth embodiment.

As show in FIGS. 24, 25, the base bracket 6 is provided with a cover 65 to surround a connector head portion 12 of each of the ignition coils 1. Multiple elastic members 7 are provided correspondingly between the cover 65 and the connector head portions 12 of the ignition coils 1. Each of the elastic members 7 is eccentric relative to the axial center X of each of the ignition coils 1. Each of the elastic members 7 is formed of an elastic element such as a solid rubber, a foam rubber, and a foam resin.

The four ignition coils 1 are mounted respectively to the sparkplugs 5 each screwed into the corresponding plughole 81. Specifically, in this embodiment, the four ignition coils 1 are mounted to the base bracket 6, and subsequently, the base bracket 6 is mounted with the cover 65 to surround the connector head portions 12 of the four ignition coils 1. In this condition, each elastic member 7 is provided between the cover and the connector head portion 12 of each of the four ignition coils 1 such that each elastic member 7 is arranged eccentrically relative to the center axis X of each ignition coil 1.

In this condition, the ignition coils 1 are arranged in the base bracket 6, and the ignition coils 1 are not fixed to the base bracket 6 using coil-screws. In this condition, the elastic members 7 are elastically deformable to change the positions of the ignition coils 1 when the plug caps 4 are applied with pressing force from the sparkplugs 5.

Thus, the four ignition coils 1, the four elastic member 7, and the cover 65 are assembled to the base bracket 6 to construct a pre-assembly 10.

Subsequently, as shown in FIG. 25, the base bracket 6 of the pre-assembly 10 is mounted to the engine 8, so that the insulator 51 of each of the sparkplugs 5 is fitted to the plug-fitting hole 41 of each of the plug caps 4. In this condition, when the insulator 51 of each of the sparkplugs 5 applies the pressing force to the plug cap 4 of each of the ignition coils 1, each ignition coil 1 is inclined around each elastic member 7 as a pivot, by arranging each elastic member 7 eccentrically relative to the axial center X of each ignition coil 1.

The insulator 51 of each sparkplug 5 primarily makes contact with the axially most protruding portion of the circumferential portions of the axial end surface 421A of each plug cap 4.

In this structure, the fitting of each ignition coil 1 starts primarily from the axially most protruding portion. Starting of the fitting of each ignition coil 1 is delayed at each circumferential portion of the plug-fitting hole 41 with respect to the circumferential direction C. In this structure, the fitting force applied when the four ignition coils 1 are fitted can be reduced in the structure in which the four ignition coils 1 are simultaneously mounted to the four sparkplugs 5.

In this embodiment, the structure other than the above feature is similar to those in the fifth to seventh embodiments, so that the plug cap 4 in this embodiment is capable of producing an effect similarly to the fifth to seventh embodiments.

Ninth Embodiment

Figure 26:
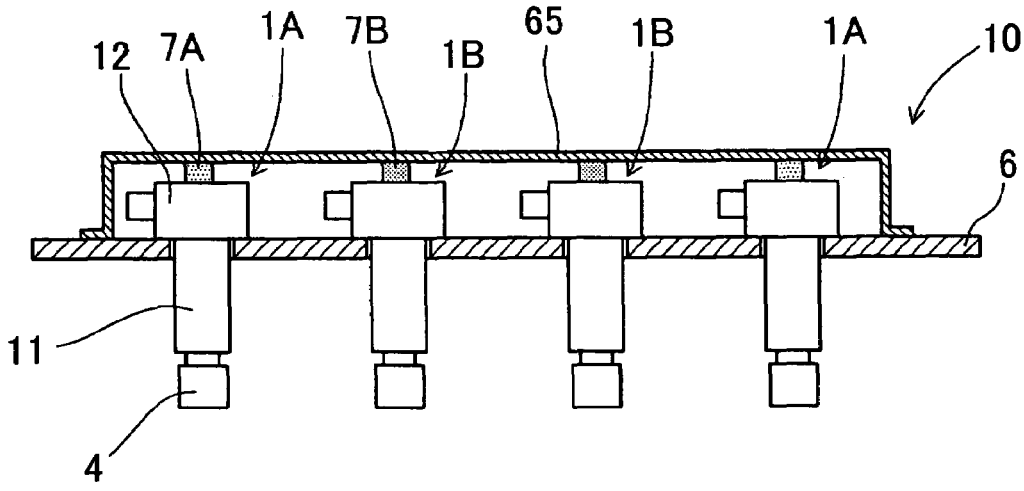
FIG. 26 is a partially sectional view showing a pre-assembly, according to a ninth embodiment.

As shown in FIG. 26, elasticity of at least one of the four elastic members 7 is different from elasticity of the other of the four elastic members 7 described in the eighth embodiment.

Specifically, the Young's modulus of at least one of the four elastic members 7 is different from the Young's modulus of the other of the four elastic members 7. For example, the Young's modulus of each of the two elastic members 7A on the outer side is different from the Young's modulus of each of the two elastic members 7B on the inner side.

In this embodiment, the four ignition coils 1 are mounted respectively to the sparkplugs 5 each screwed into the corresponding plughole 81. Specifically, the four ignition coils 1, the four elastic member 7, and the cover 65 are assembled to the base bracket 6 to construct a pre-assembly 10, similarly to the eighth embodiment.

Subsequently, the base bracket 6 of the pre-assembly 10 is mounted to the engine 8, so that the insulator 51 of each of the sparkplugs 5 is fitted to the plug-fitting hole 41 of each of the plug caps 4. The insulator 51 of each of the sparkplugs 5 applies the pressing force to plug-fitting hole 41 of the plug cap 4 of each of the ignition coils 1. In this condition, peaks of resistance caused in the fitting of the plug caps 4A of the outer two ignition coils 1A each provided with the elastic member 7A having the small Young's modulus are delayed relative to peaks of resistance caused in the fitting of the plug caps 4B of the inner two ignition coils 1B each provided with the elastic member 7B having the large Young's modulus.

In this structure, the fitting force applied when the four ignition coils 1 are fitted can be reduced in the structure in which the four ignition coils 1 are simultaneously mounted to the four sparkplugs 5.

Figure 27:
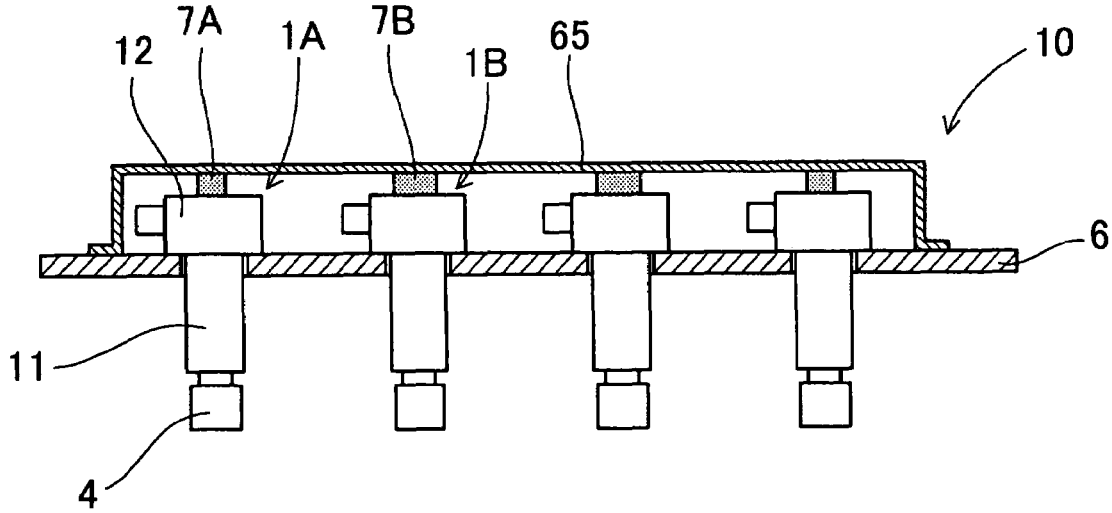
FIG. 27 is a partially sectional view showing another pre-assembly, according to the ninth embodiment.

As shown in FIG. 27, the crosssectional area of at least one of the four elastic members 7 is different from the crosssectional area of the other of the four elastic members 7. In this structure, the elasticity of at least one of the four elastic members 7 is different from the elasticity of the other of the four elastic members 7. For example, the crosssectional area of each of the two elastic members 7A on the outer side can be reduced compared with the crosssectional area of each of the two elastic members 7B on the inner side.

Figure 28:
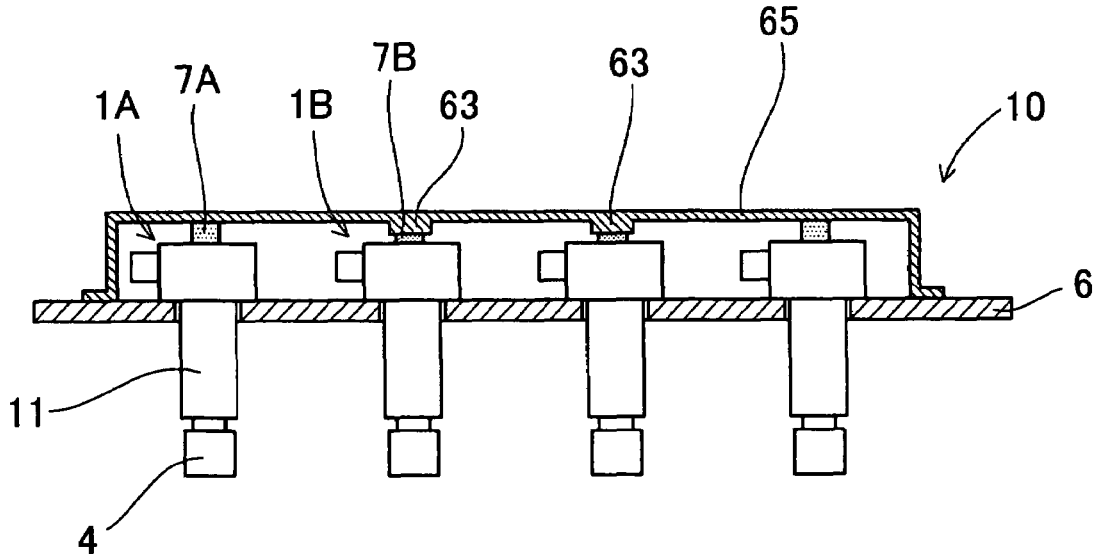
FIG. 28 is a partially sectional view showing another pre-assembly, according to the ninth embodiment.

As shown in FIG. 28, compression of at least one of the four elastic members 7 is different from compression of the other of the four elastic members 7. In this structure, elasticity of at least one of the four elastic members 7 is different from elasticity of the other of the four elastic members 7.

For example, the inner surface of the cover 65 may be provided with protrusions 63 correspondingly opposed to the elastic members 7B, which are arranged on the inner side. In this structure, the thickness of each of the elastic members 7B on the inner side can be reduced compared with the thickness of each of the elastic members 7B on the outer side, with respect to the compressive direction.

In this embodiment, the structure other than the above feature is similar to those in the fifth to eighth embodiments, so that the plug cap 4 in this embodiment is capable of producing an effect similarly to the fifth to eighth embodiments.

Tenth Embodiment

Figure 29:
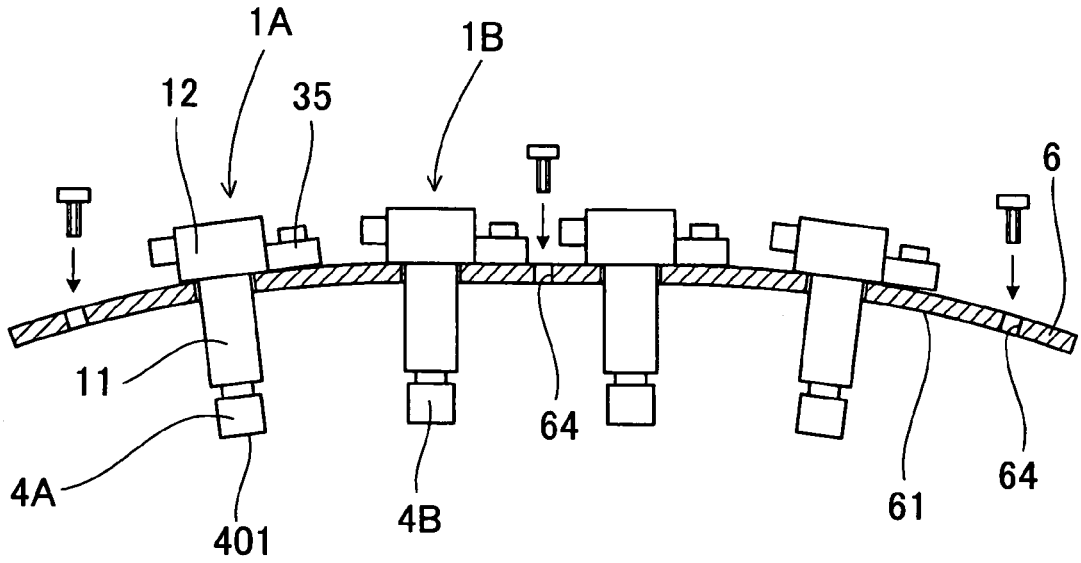
FIG. 29 is a partially sectional view showing a pre-assembly, according to a tenth embodiment.

As shown in FIG. 29, for example, the base bracket 6 is bent with respect to the lateral direction, along which the four ignition coils 1 are arranged on the base bracket 6, in an initial condition before the base bracket 6 is mounted to the engine 8. The four ignition coils 1, which are arranged on the base bracket 6, are mounted respectively to the sparkplugs 5 each screwed into the corresponding plughole 81, by mounting the base bracket 6, which is bent, to the engine 8. In this embodiment, the backside reference surface 61, via which the base bracket 6 is opposed to the engine 8, is bent to define a concavity in the initial condition.

Figure 30:
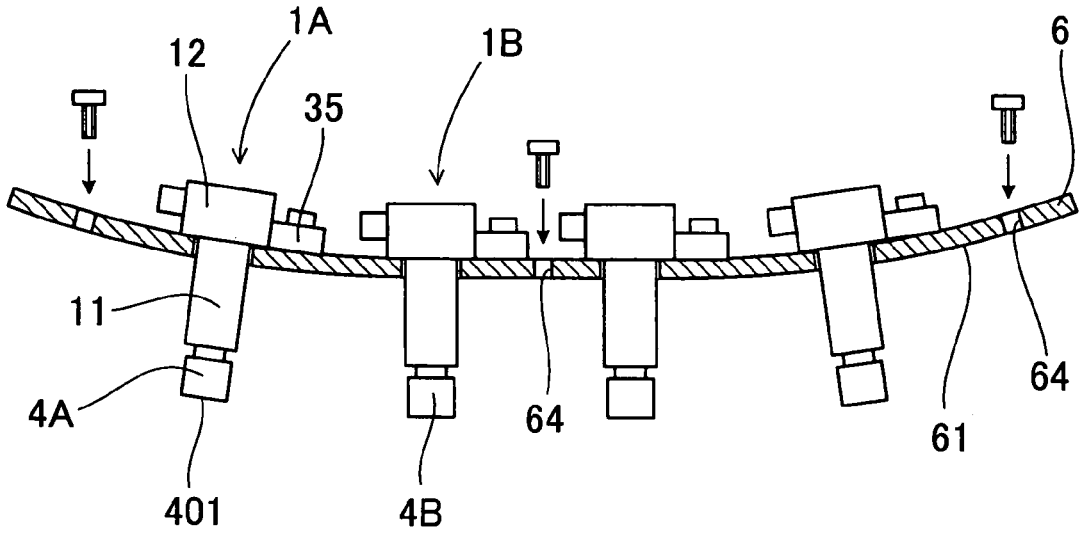
FIG. 30 is a partially sectional view showing another pre-assembly, according to the tenth embodiment.

As shown in FIG. 30, the backside reference surface 61, via which the base bracket 6 is opposed to the engine 8, may be bent to define a convexity in the initial condition.

Referring to FIG. 29, in this embodiment, the base bracket 6 has lateral ends and lateral center each having a through hole 64 through which a bracket-screw is inserted. The base bracket 6, which is bent, is mounted to the engine 8 by screwing the bracket-screws through the through holes 64, so that the bent base bracket 6 is corrected in shape to be substantially straight.

In this embodiment, when the four ignition coils 1 are mounted respectively to the sparkplugs 5 each screwed into the corresponding plughole 81, the four ignition coils 1 are assembled to the base bracket 6, which is being bent. In this condition, the axial end position 401 of the plug cap 4A of each of two ignition coils 1A on the outer side protrudes relative to the axial end position 401 of the plug cap 4B of each of two ignition coils 1B on the inner side, by bending the base bracket 6.

Subsequently, the base bracket 6, which is provided with the four ignition coils 1, is mounted to the engine 8, so that the insulator 51 of each of the sparkplugs 5 is fitted to the plug-fitting hole 41 of each of the plug caps 4. In this condition, the plug-fitting hole 41 of the plug cap 4A of each of two ignition coils 1A on the outer side makes contact with the corresponding insulator 51 of the sparkplug 5 prior to the plug-fitting hole 41 of the plug cap 4B of each of two ignition coils 1B on the inner side.

In this structure, the fitting of the insulators 51 of the sparkplugs 5 into the plug-fitting holes 41 of the plug caps 4 are conducted primarily from the plug-fitting holes 41 of the plug caps 4A of the two ignition coils 1A on the outer side. The starting of the fitting of the ignition coils 1B on the inner side is staggered with respect to the starting of the fitting of the ignition coils 1A on the outer side. In this structure, the fitting force applied when the four ignition coils 1 are fitted can be reduced in the structure in which the four ignition coils 1 are simultaneously mounted to the four sparkplugs 5.

In this embodiment, the structure other than the above feature is similar to those in the fifth to ninth embodiments, so that the plug cap 4 in this embodiment is capable of producing an effect similarly to the fifth to ninth embodiments.

The above structures of the embodiments can be combined as appropriate.

It should be appreciated that while the processes of the embodiments of the present invention have been described herein as including a specific sequence of steps, further alternative embodiments including various other sequences of these steps and/or additional steps not disclosed herein are intended to be within the steps of the present invention.

Various modifications and alternations may be diversely made to the above embodiments without departing from the spirit of the present invention.

What is claimed is:

1. An ignition coil adapted to being mounted to a sparkplug, the ignition coil comprising:

a coil body including a primary coil and a secondary coil; and a plug cap provided to an axial end of the coil body, wherein the coil body is adapted to being mounted to the sparkplug via the plug cap, the plug cap has a plug-fitting hole adapted to being axially fitted to an insulator of the sparkplug, the plug cap has an end surface defining the plug-fitting hole, the end surface includes circumferential portions respectively located at axial positions each being variously changed with respect to a circumferential direction, and the circumferential portions and inner circumferential edges of the end surface are configured to be in continuous contact with an outer circumferential periphery of the insulator of the sparkplug about an entire circumference of the insulator, whereby the plug cap and the insulator are electrically insulated and sealed with respect to one another to define a water-proof structure.

2. The ignition coil according to claim 1, wherein the end surface is inclined.

3. The ignition coil according to claim 1, wherein the circumferential portions of the end surface partially define a protrusion axially protruding to form a stepwise surface.

4. The ignition coil according to claim 1, wherein the insulator has annular protrusions, which are arranged substantially in parallel with each other with respect to an axial direction to define a first corrugation, the plug cap has an inner circumferential periphery, which defines a second corrugation, and the second corrugation is engaged with the first corrugation and closely in contact with the first corrugation when the plug cap is fitted to the insulator.

5. The ignition coil according to claim 1, wherein the circumferential portions respectively have inclined surfaces, each being inclined with respect to the circumferential direction, and two of the circumferential portions, which are adjacent to each other, defining a step therebetween.

6. The ignition coil according to claim 1, wherein the circumferential portions define protrusions, which protrude from the end surface of the plug cap with respect to an axial direction, and the circumferential portions are arranged with respect to the circumferential direction.

7. The ignition coil according to claim 1, wherein the end surface defines a stepwise surface, which has said circumferential portions, each protruding in an axial direction, and a main portion recessed with respect to the circumferential portions, the circumferential portions being spaced from one another with respect to the circumferential direction by the main portion, wherein each of the circumferential portions has a first thickness in a radial direction, said first thickness being less than a thickness of said main portion.

8. An ignition coil adapted to being mounted to a sparkplug, the ignition coil comprising:

a coil body including a primary coil and a secondary coil; and a plug cap provided to an axial end of the coil body, wherein the coil body is adapted to being mounted to the sparkplug via the plug cap, the plug cap has a plug-fitting hole adapted to being axially fitted to an insulator of the sparkplug, the plug cap has an inner circumferential edge defining the plug-fitting hole, the inner circumferential edge includes circumferential portions respectively located at axial positions each being variously changed with respect to a circumferential direction, and the circumferential portions and inner circumferential edges of the end surface are configured to be in continuous contact with an outer circumferential periphery of the insulator of the sparkplug about an entire circumference of the insulator, whereby the plug cap and the insulator are electrically insulated and sealed with respect to one another to define a water-proof structure.

9. The ignition coil according to claim 8, wherein the inner circumferential edge is inclined.

10. The ignition coil according to claim 8, wherein the insulator has annular protrusions, which are arranged substantially in parallel with each other with respect to an axial direction to define a first corrugation, the plug cap has an inner circumferential periphery, which defines a second corrugation, and the second corrugation is engaged with the first corrugation and closely in contact with the first corrugation when the plug cap is fitted to the insulator.

11. The ignition coil according to claim 8, wherein the circumferential portions respectively have inclined surfaces, each being inclined with respect to the circumferential direction, and two of the circumferential portions, which are adjacent to each other, defining a step therebetween.

12. The ignition coil according to claim 8, wherein the circumferential portions define protrusions, which protrude from the end surface of the plug cap with respect to an axial direction, and the circumferential portions are arranged with respect to the circumferential direction.

13. An ignition coil adapted to being mounted to a sparkplug, the ignition coil comprising:

a coil body including a primary coil and a secondary coil; and a plug cap provided to an axial end of the coil body, wherein the coil body is adapted to being mounted to the sparkplug via the plug cap, the plug cap has a plug-fitting hole adapted to being axially fitted to an insulator of the sparkplug, the plug cap has an end defining the plug-fitting hole, the end includes circumferential portions each having a radial thickness being changed with respect to a circumferential direction, and the circumferential portions and inner circumferential edges of the end defining the plug-fitting hole are configured to be in continuous contact with an outer circumferential periphery of the insulator of the sparkplug about an entire circumference of the insulator, whereby the plug cap and the insulator are electrically insulated and sealed with respect to one another to define a water-proof structure.

14. The ignition coil according to claim 13, wherein the insulator has annular protrusions, which are arranged substantially in parallel with each other with respect to an axial direction to define a first corrugation, the plug cap has an inner circumferential periphery, which defines a second corrugation, and the second corrugation is engaged with the first corrugation and closely in contact with the first corrugation when the plug cap is fitted to the insulator.

15. The ignition coil according to claim 13, wherein the circumferential portions respectively have inclined surfaces, each being inclined with respect to the circumferential direction, and two of the circumferential portions, which are adjacent to each other, defining a step therebetween.

16. The ignition coil according to claim 13, wherein the circumferential portions define protrusions, which protrude from the end surface of the plug cap with respect to an axial direction, and the circumferential portions are arranged with respect to the circumferential direction.

* * * * *